US010952556B2

(12) United States Patent
Hara

(10) Patent No.: US 10,952,556 B2
(45) Date of Patent: Mar. 23, 2021

(54) HOUSING DEVICE

(71) Applicant: Shuhei Hara, Tokyo (JP)

(72) Inventor: Shuhei Hara, Tokyo (JP)

( * ) Notice: Subject to any disclaimer, the term of this patent is extended or adjusted under 35 U.S.C. 154(b) by 0 days.

(21) Appl. No.: 16/255,712

(22) Filed: Jan. 23, 2019

(65) Prior Publication Data

US 2019/0223643 A1 Jul. 25, 2019

(30) Foreign Application Priority Data

Jan. 24, 2018 (JP) ..... JP2018-009746

(51) Int. Cl.
*A47G 29/14* (2006.01)
*A47G 29/20* (2006.01)
*E05B 65/52* (2006.01)

(52) U.S. Cl.
CPC ..... *A47G 29/141* (2013.01); *A47G 29/20* (2013.01); *A47G 2029/145* (2013.01); *A47G 2029/148* (2013.01); *A47G 2029/149* (2013.01); *E05B 65/52* (2013.01)

(58) Field of Classification Search
CPC ..... A47G 29/1201; A47G 29/1218; A47G 29/141; A47G 29/20; A47G 29/16; A47G 2029/145; A47G 2029/148; A47G 2029/149; E05B 65/52
USPC ..... 232/17, 19, 24, 25, 34–36, 38, 45; 70/63; 340/569
See application file for complete search history.

(56) References Cited

U.S. PATENT DOCUMENTS 6,987,452 B2 * 1/2006 Yang ..... A47G 29/141 232/36
10,643,173 B2 * 5/2020 Simms ..... G06Q 10/0836
2001/0050615 A1 * 12/2001 Kucharczyk ..... A47G 29/141 340/568.1
2002/0162883 A1 * 11/2002 Arvonio ..... G07B 17/00193 232/45
2003/0079129 A1 * 4/2003 Lindsay ..... G07F 17/12 713/176
2003/0231112 A1 * 12/2003 Raju ..... A47G 29/141 340/569
2010/0006636 A1 * 1/2010 Frankenberg ..... A47G 29/22 232/44
2010/0085148 A1 * 4/2010 Nesling ..... G07C 9/00912 340/5.73
2016/0066732 A1 * 3/2016 Sarvestani ..... G07F 17/12 232/24
2018/0078992 A1 * 3/2018 High ..... G06Q 10/08
2018/0177319 A1 * 6/2018 Willis ..... A47G 29/141
(Continued)

FOREIGN PATENT DOCUMENTS

JP 3211602 U * 7/2017

*Primary Examiner* — William L Miller
(74) *Attorney, Agent, or Firm* — FisherBroyles, LLP; Rob L. Phillips

(57) ABSTRACT

A housing system is provided with a housing device 10 that is installed, for example, at an entrance of an individual house of a user, and stores a delivery object or the like addressed to the user while being locked, and a managing server 20 for managing the housing state of the housing device 10. The housing device 10 has, for example, a square pillar shape, and on its one side face, a display for use in displaying and keys or the like for use in inputting information are disposed, on the other two side faces, doors of housing boxes are disposed.

7 Claims, 27 Drawing Sheets

(56) References Cited

U.S. PATENT DOCUMENTS

2019/0147559 A1* 5/2019 Lee ..... A47G 29/20
705/332
2019/0167025 A1* 6/2019 Cherry ..... A47G 29/141

* cited by examiner

IDENTIFICATION DB 121

| USER ID | USER NAME/ ENTREPRENEUR NAME | IDENTIFICATION INFORMATION | PURPOSE OF USE | | | |
|---|---|---|---|---|---|---|
| | | | UNLOCKING UNUSED HOUSING SPACE | UNLOCKING USED HOUSING SPACE | | |
| | | | | STORAGE OF DELIVERY OBJECT | REQUEST FOR DELIVERY | REQUEST FOR LAUNDRY |
| 0001 | ○○ ○○ | 1112 | ○ | ○ | ○ | ○ |
| 0002 | ○○ ○○ | 8552 | ○ | × | ○ | × |
| 0003 | ○○ ○○ | 4412 | ○ | × | × | ○ |
| ⋮ | ⋮ | ⋮ | ⋮ | ⋮ | ⋮ | ⋮ |

FIG. 8

FIG. 9

HOUSING BOX DB 122

| HOUSING SPACE | HOUSING STATE | PURPOSE OF USE |
|---|---|---|
| A | DURING HOUSING | STORAGE OF DELIVERY OBJECT |
| B | UNHOUSING | --- |
| C | UNUSEBLE | --- |
| ⋮ | ⋮ | ⋮ |

HOUSING DEVICE

CROSS-REFERENCE TO RELATED APPLICATIONS

The present invention claims benefit of Japanese Patent Application No. 2018/009746, filed Jan. 24, 2018, the contents of which are incorporated herein.

FIELD OF THE INVENTION

The present invention relates to a housing device, and in particular concerns a personal-use housing device in which a delivery object or the like is stored.

BACKGROUND

In recent years, a housing device that is lockable and referred to as a home delivery locker has been disposed in a commonly-used part or the like of condominium houses, and utilized for services, such as receiving or the like of a home delivery object.

In the receiving service of a home delivery object by the use of this home delivery locker, even when a resident of condominium houses is not at home, a home delivery agent deposits a delivery object addressed to the resident in a box in the home delivery locker and locks the box, and thereafter, the resident can unlock the corresponding box and take out the deliver object addressed to him or her.

In this manner, it becomes possible to prevent theft or the like of the delivery object and consequently to allow the resident to safely receive the delivery object.

Moreover, the home delivery locker is provided with a plurality of housing boxes of various sizes, and is designed to store packages of various sizes.

As one of prior art techniques relating to home delivery services in which this home delivery locker is utilized, Patent Document 1 has proposed a locker system.

In the locker system of Patent Document 1, when a delivery agent delivers a package addressed to a resident in condominium houses, the delivery agent selects a locker box that is coincident with the size of the package at home delivery lockers installed at the condominium houses or the like, and stores the package in the box and locks the box.

In this manner, by utilizing the home delivery locker, even in the case when the receiver of the package is not at home at the time of delivery, the receiver can easily receive the package addressed to him or her from the home delivery locker after coming home.

On the other hand, since it is not necessary for the delivery agent to redeliver, the delivery agent can carry out the delivery business efficiently.

SUMMARY

As described above, the home delivery locker is installed in condominium houses or the like, and is generally utilized by residents; however, in recent years, the demands thereof have increased among residents in individual houses.

However, since individual houses in particular, in cities have narrower housing areas in comparison with condominium houses, a problem arises in which it is difficult to ensure an installation place for home delivery locker having housing boxes that allow deposits of packages having various sizes.

On the other hand, in the case when the size of the housing boxes of the home delivery locker to be installed at individual houses is made smaller so as to be suitable for the housing areas of the individual houses, a problem arises in which it is not suitably deal with packages of various sizes, in particular, packages of large sizes or long sizes, thereby causing re-delivery or the like.

In view of the above-mentioned problems, the present invention has been devised, and its object is to provide a housing device capable of housing packages of various sizes in individual houses, and also capable of effectively utilizing installation spaces.

In order to achieve the above-mentioned object, the housing device of the present invention is provided with: housing boxes each capable of housing an article; a housing part including an opening formed at one portion of the housing box and capable of shielding the opening with a door and locking the door; an operation part on which an operation for unlocking the door is carried out; and an information output part (for example, display part or voice output part) for outputting information at the time of unlocking the door, wherein the door of the housing box is formed on a surface that is different from surfaces on which the operation part and the information output part are installed.

Moreover, in accordance with the housing device of the present invention, a plurality of openings are formed on mutually different surfaces of the housing box, and inside the housing box, one or more shelf plates are installed so as to partition housing spaces of the housing box so that at least one of the plural openings has a door for each of the plural housing spaces that are partitioned, and at least one of the other openings is provided with doors in a manner so as to straddle over the plural housing spaces that are partitioned.

Furthermore, the housing device in accordance with the present invention is provided with a control part for controlling operations of the entire housing device; a detection part for detecting an article housed in the housing space so as to output a detection signal indicating the detection results to the control part, and when a detection signal indicating that an article is stored in any one of the plural housing spaces that are partitioned is inputted thereto from the detection part, the control part does not unlock the door that shields openings of the housing space having the article housed therein and another housing space in a manner so as to straddle over these.

Moreover, in accordance with the housing device of the present invention, the shelf plate is designed to be able to cancel the partitions when being moved, and a movement regulating part for regulating the shelf plate is provided, and this configuration is characterized in that in the case when a door that is kept in a straddled state over a plurality of housing spaces is unlocked, the movement regulating part releases the regulation of movements of the shelf plate that partitions the plural of the housing spaces in the straddled state.

Moreover, the housing device in accordance with the present invention is further provided with an article detection part for detecting any article stored inside the housing box, and in the case when the article detection part has detected that any article is stored in any one of partitioned housing spaces, the housing part regulates unlocking of a door that is kept in a straddled state over a plurality of housing spaces including the housing space having the article therein.

Additionally, any desired combinations of the above-mentioned constituent elements, and arrangements formed by mutually substituting the constituent elements and expressions with one another, among the device, system, computer program, recording media storing the computer program are also effectively used as modes of the present invention.

The housing device of the present invention is provided with: housing boxes each capable of housing an article; a housing part including an opening formed at one portion of the housing box and capable of shielding the opening with a door and locking the door; an operation part on which an operation for unlocking the door is carried out; and an information output part for outputting information at the time of unlocking the door, wherein the door of the housing box is formed on a surface that is different from a surface on which the operation part and the information output part are installed; therefore, a large housing space of the housing space is available, and packages having various sizes can be stored in a limited installation space.

BRIEF DESCRIPTION OF THE DRAWINGS

FIG. 8 is a drawing that shows one example of a data configuration of an identification DB in the first embodiment of the present invention.

FIG. 9 is a drawing that shows one example of a data configuration of a housing box DB in the first embodiment of the present invention.

DETAILED DESCRIPTION

In a housing system in accordance with a first embodiment of the present invention, a housing device 10 is installed at an entrance or the like of an individual house of a user, and has a housing box so as to lockably store a delivery object (including mail) addressed to the user in the housing box.

The housing device 10 has, for example, a square pillar shape, and on one of its four side faces, a display-use display, keys for use in information input and the like are disposed, with the other two side faces being provided with doors for housing boxes.

Either of doors on the two side faces may be opened to store an article into a commonly-used housing box or take out an article from the housing box.

In the case of a general-use home delivery locker, on the door of the housing box, a display and information input keys are installed on the same surface; in contrast, as described above, in the housing device 10 of the present embodiment, different from the general-use home delivery locker, the display and information input keys are disposed on a surface different from the door of the housing box.

Therefore, the housing device 10 in the present embodiment makes it possible to widen the area of the door in comparison with the above-mentioned general-use home delivery locker, and consequently to easily house a large-size or long-size article.

Figure 1:
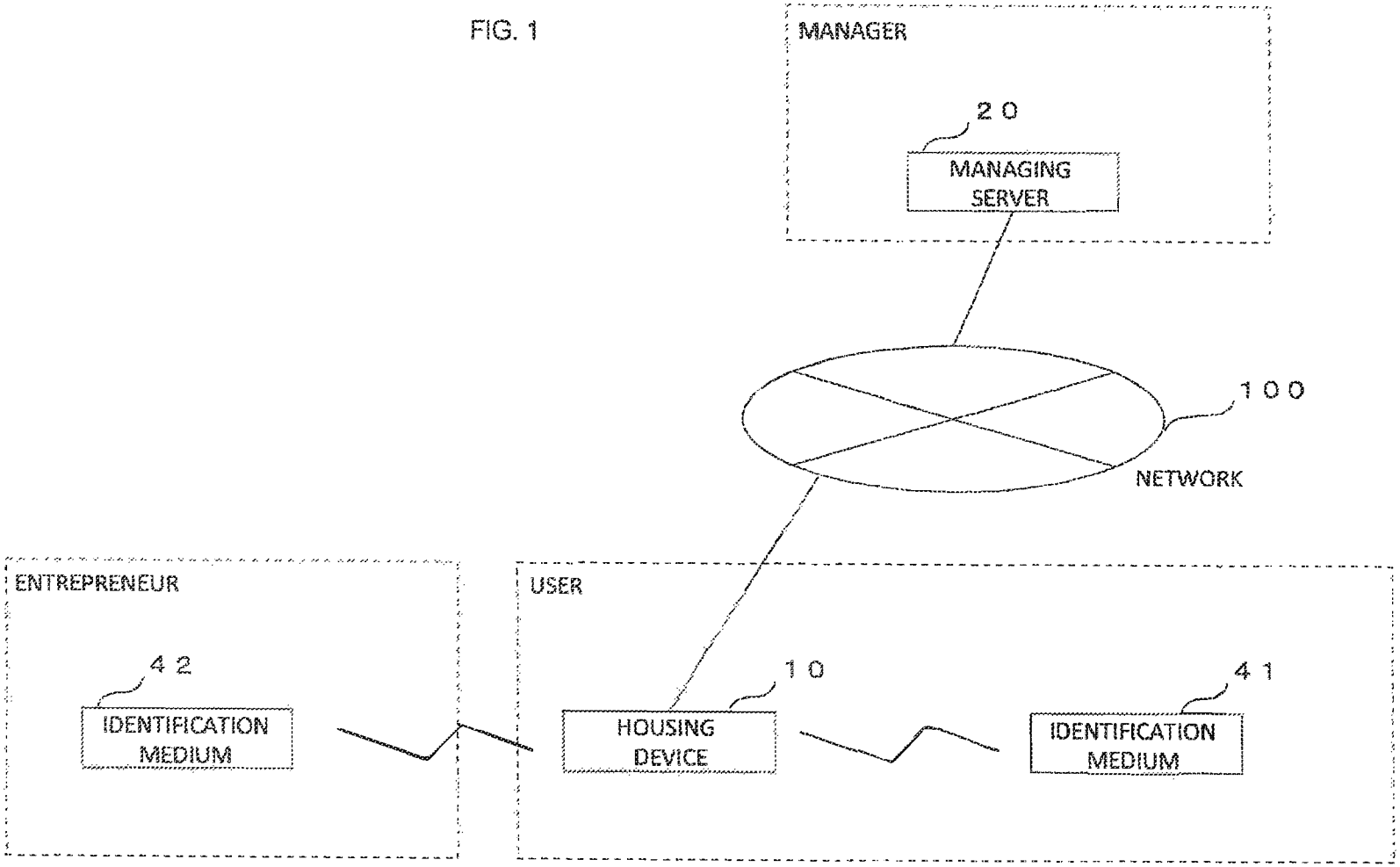
FIG. 1 is a drawing that shows a configuration of a housing system in accordance with an embodiment of the present invention.

FIG. 1 is a drawing that shows a configuration of a housing system in accordance with an embodiment of the present invention. Referring to the drawing, explanation will be given to the configuration of the housing system.

The housing system is provided with a housing device 10 that is installed at an entrance or the like of an individual house of a user so as to store a delivery object or the like addressed to the user while being locked and a managing server 20 for managing the housing state of the housing device 10.

As shown in the drawing, the managing server 20 is communicatably connected to the housing device 10 through a network 100, such as the Internet, LAN or the like.

(1) Configuration of Housing Device 10.

(a) Entire Configuration of Housing Device 10

The housing device 10 is provided with one or more housing boxes, and temporarily stores a user's article in the housing box while being locked.

As described earlier, the housing device 10 is installed, for example, at an entrance of an individual house, or within a site of an individual house, such as a garden, a parking lot or the like.

For example, even when a user is not at home, a delivery agent can temporarily stores a delivery object addressed to the user in the housing device 10 and locks the device, and the user is allowed to take out the delivery object later from the housing device 10.

Moreover, the user's article to be stored in the housing box includes, for example, a delivery object addressed to the user, an object requested by the user to be delivered, clothes requested by the user for laundry (including clothes before and after laundry), or the like.

The user's article includes an article to be stored in the housing box by a user himself or herself, or on the other hand, an article to be stored in the housing box for the user by each of entrepreneurs, such as a delivery agent, a laundry agent, an entrepreneur of a retail store, or the like.

Figure 2:
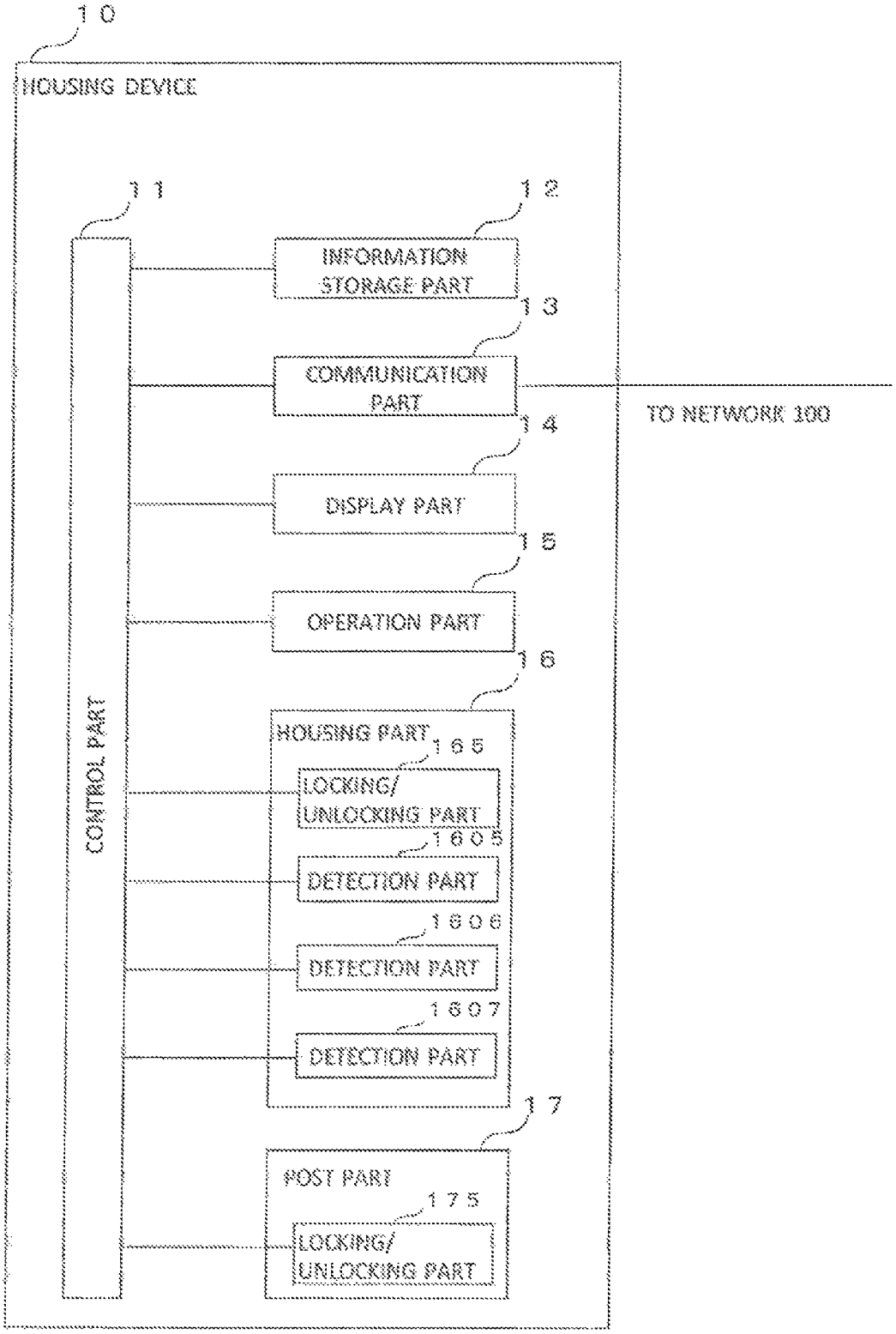
FIG. 2 is a drawing that shows a configuration of a housing device in a first embodiment of the present invention.

FIG. 2 is a drawing that shows a configuration of the housing device 10 in accordance with the first embodiment of the present invention.

Figure 3:
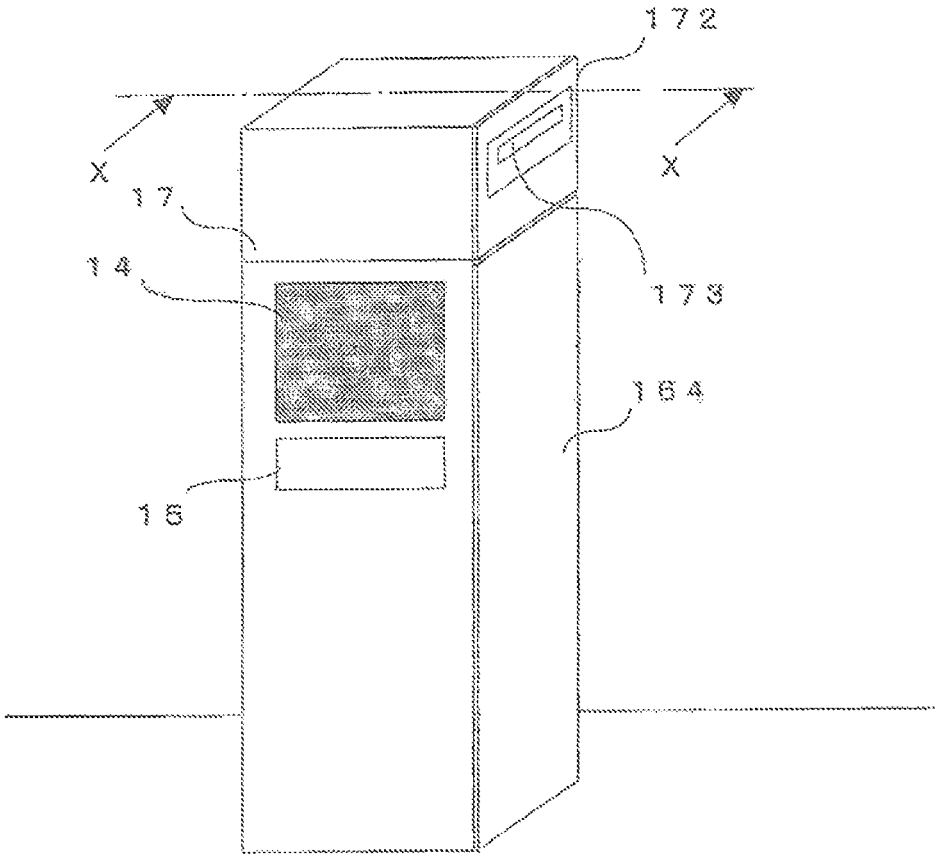
FIG. 3 is a drawing that shows an appearance on a front side of the housing device in the first embodiment of the present invention.
Figure 4:
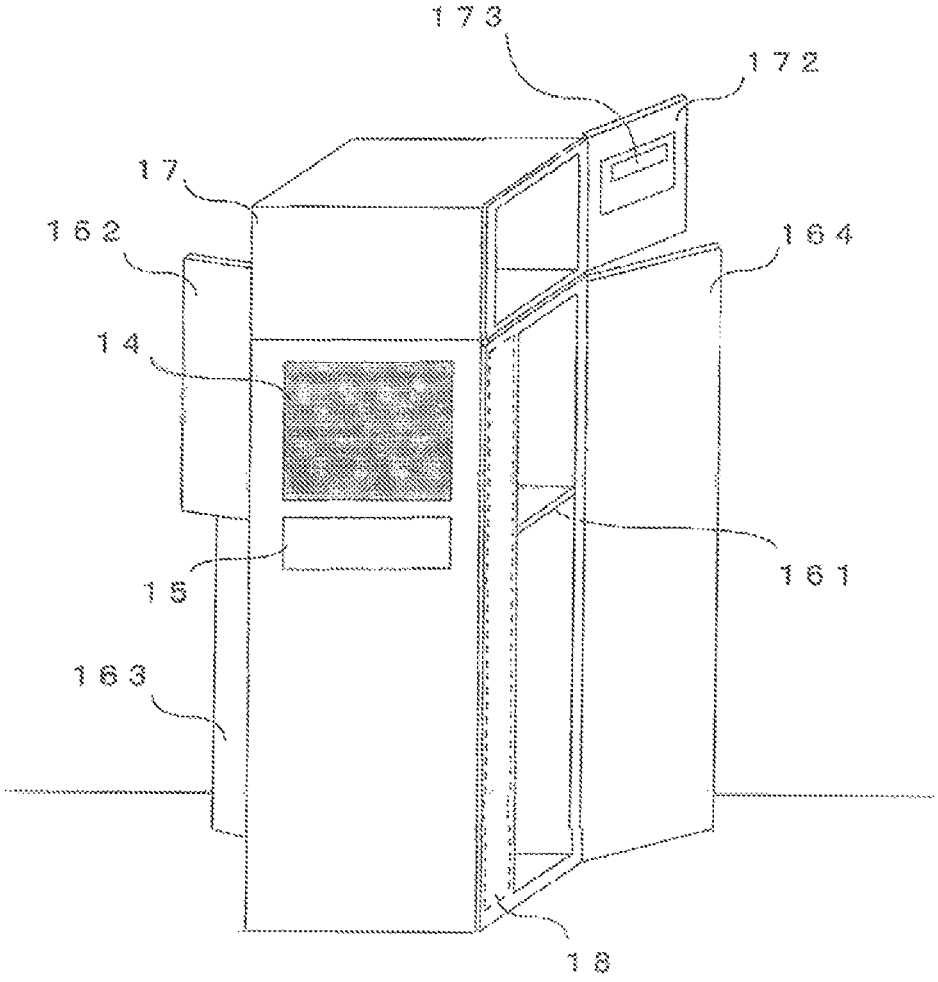
FIG. 4 is a drawing that shows the appearance on a front surface side of the housing device in the first embodiment of the present invention.

FIGS. 3 and 4 are drawings that show appearances on the front side of the housing device 10 in accordance with the first embodiment of the present invention, FIG. 3 shows a state in which each of the doors is closed, and FIG. 4 shows a state in which each of the doors is opened.

As shown in the drawings, the housing device 10 is provided with a control part 11 for controlling the entire housing device 10 constituted by a CPU and the like, an information storage part 12 for storing various pieces of information, a communication part 13 for carrying out communications with a managing server 20 through a network 100, a display part 14 for displaying various pieces of information, an operation part 15 that is provided with various kinds of keys or the like, capable of information inputs, and used for carrying out various operations, such as inputs or the like of identification information for unlocking the housing boxes, a housing part 16 provided with housing boxes for housing an article, such as a delivery object addressed to the user or the like, a post part 17 for housing a delivery object that can be posted from the post opening for postal objects or the like, and a circuit housing part 18 that physically houses circuits forming the above-mentioned control part 11, information storage part 12, communication part 13, display part 14 and operation part 15.

The respective parts 11 to 17 are connected to an inner bus, and various pieces of information or the like are inputted/outputted to/from the bus so that under control by the control part 11, various processes are executed.

In the example shown in FIGS. 3 and 4, the housing device 10 has a square pillar shape, and on the front surface 101 side, the display part 14 and the operation part 15 are installed.

Moreover, as shown in the drawings, on the back side of the front surface 101 side, the circuit housing part 18 having a thin plate shape is formed along the corresponding back side.

In the example shown in FIGS. 3 and 4, doors 162, 163 and 164 of the housing boxes are formed on two side faces 102 and 103 that are different from the front surface on which the display part 14 and the operation part 15 are installed, so as to be opposed to each other.

The control part 11, which is a processing part for controlling the entire housing device 10, includes, for example, electronic circuits, such as a CPU (Central Processing Unit) or the like and integrated circuits, such as FPGA (Field-Programmable Gate Array) or the like.

The control part 11 executes reading operation of information from the information storage part 12 and also executes writing processes of information on the information storage part 12.

The information storage part 12 is a device for storing information, such as a hard disc, a memory, a semiconductor element, or the like.

The information storage part 12 is provided with a region for storing programs to be executed in the control part 11 and a work region (RAM, etc.) or the like that is temporarily used when the control part 11 executes processes, and stores data bases and tables to be described later.

The control part 11 reads out a program stored in the information storage part 12 and develops it on the work region so as to execute various processes.

The communication part 13 corresponds to an interface for controlling communications with the communication server 20 through the network 100, and is provided with a LAN adopter or the like.

The communication part 13 may have a wireless transmitter/receiver, and may be connected to the LAN, Internet or the like through wireless communication, or may be connected thereto through a wire such as a cable or the like.

The display part 14 is a display device, such as a display, lamps or the like.

The control part 11 reads out an image from the information storage part 12, and generates screen information by executing an image output process thereon.

Moreover the control part 11 executes an image output process on image information received from the managing server 30 by the communication part 13, and generates screen information.

The control part 11 outputs the generated image information onto the display part 14.

The display part 14 executes screen display of the inputted image information on a display or the like.

Moreover, the control part 11 may output a control signal onto the display part 14 so that lamps possessed by the display part 14 may be turned on.

The operation part 15 is provided with an information input device constituted by, for example, various keys or the like, and the information input device provides a pointing device in cooperation with the display part 14. The operation part 15 receives various operations by a user or the like, and outputs a signal indicating the operation contents to the control part 11 or the like.

Upon receipt the signal indicating the operation contents, the control part 11 outputs a control signal indicating that a screen display in response to the operation contents is carried out to the display part 14.

Upon receipt of the control signal input, the display part 14 executes a screen display in response to the control signal.

Additionally, the display part 14 and the operation part 15 may be integrally constituted to form a touch panel.

Moreover, the operation part 15 is provided with an information reading device that reads out information from an information recording medium (identification medium 41, 42 to be described later) by carrying out short-distance wireless communication, such as infrared ray communication or the like.

After reading the identification information or the like from the identification medium 41 or 42 by the operation part 15, the control part 11 carries out an identifying process for unlocking the housing part 16 based upon the identification information or the like thus read out.

Additionally, the display part 14 and the operation part 15 may be integrally constituted to form a touch panel.

When the user brings the identification medium 41 in which identification information for unlocking the key is recorded closer within a predetermined distance by holding it over the operation part 15 (information reading device), the operation part 15 reads out the identification information for unlocking the key from the identification medium 41.

The housing part 16 is designed to have one or more housing boxes that have a box shape for housing an article therein and can be locked.

Each of the housing boxes includes the housing device 10 having at least a square pillar shape, with a plurality of doors formed on different side faces thereof, and by opening the door, the portion corresponding to the door is opened so that an entrepreneur such as a delivery agent or the like can store an article from the opening portion or a user is allowed to take out the article from the corresponding opening portion.

The housing part 16 is provided with a locking/unlocking part 165 that individually locks/unlocks each of the doors of the housing boxes.

The locking/unlocking part 165 is electrically connected to the control part 11, and forms, for example, an electric lock for executing locking/unlocking based upon a control signal released from the control part 11 so that the locked/unlocked state of the door of the housing boxes can be detected.

To the door of the housing box, an urging force in the opening direction is exerted, and when unlocked by the locking/unlocking part 165, the door is automatically opened.

Moreover, in the case when a user tries to store an article into the housing box to be locked therein, by allowing the user to close the door by exerting a force against the urging force, the door is automatically locked.

Furthermore, the locking/unlocking part 165 is provided with a locking lever so that when the user closes the door of the housing box, by allowing the user to operate the locking lever, the door 162 may be locked by physically moving a member possessed by the locking/unlocking part 165.

Not limited by the above-mentioned electric locking device or locking lever mechanism, the locking/unlocking part 165 may be provided with any general-use locking/unlocking device conventionally proposed.

In the case when no article is housed, although the housing box is locked, the unlocking and opening the door can be carried out by using a predetermined key operation or the like, without the identification process.

On the other hand, in the case when any article is stored in the housing box and locked, a user inputs identification information by bringing the identification medium 41 close to the operation part 15 or the like.

The control part 11 carries out an identifying process based upon the inputted identification information, and when the identifying process is successful, the door of the housing box is unlocked so that the article is taken out.

Figure 5:
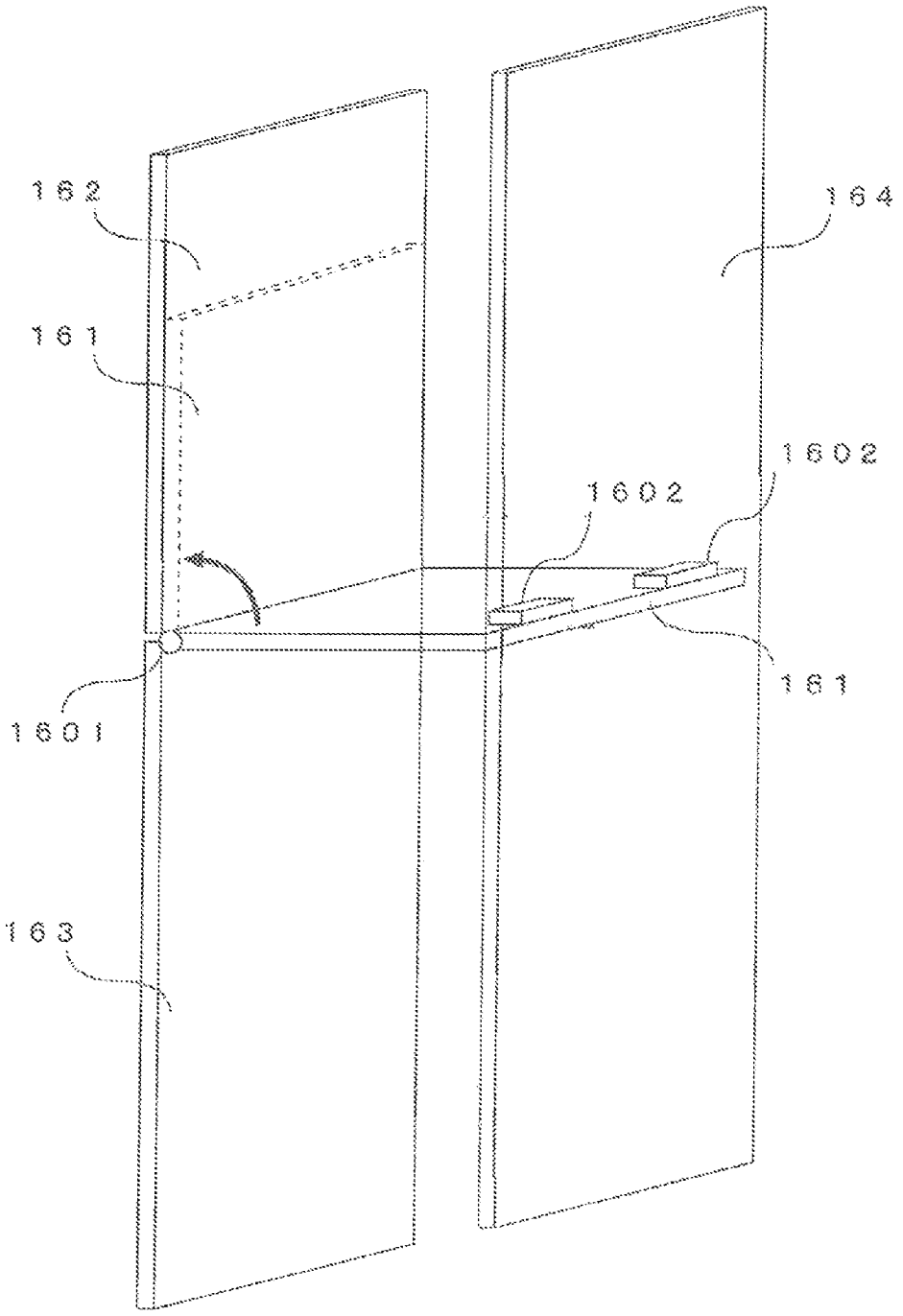
FIG. 5 is a drawing that shows a configuration of a housing part in the first embodiment of the present invention.

FIG. 5 is a drawing that shows a configuration of the housing part 16 in accordance with the first embodiment of the present invention.

In an example shown in the drawing, a movable shelf plate 161 is located at a position indicated by a solid line (hereinafter, referred to as "horizontal position"), and when a shelf is formed, the space inside the housing box of the housing part 16 is partitioned into two housing spaces A and B.

Moreover, when the shelf plate 161 is allowed to pivot around a hinge part 1601 to be moved to a position indicated by a dotted line (hereinafter, referred to as "vertical position") that is in parallel with the door 162, the partition between the housing spaces A and B is canceled so that a housing space C formed by joining the housing spaces A and B with each other is formed.

In the example shown in the drawing, as described earlier, the doors 162, 163 and 164 of the housing box are formed on side faces that are different from the side face on which the above-mentioned display part 14 and operation part 15 are installed.

On the left side face side seen from the front side of FIGS. 3 and 4, the two doors 162 and 163 are formed, and on the right side face side seen from the front side thereof, the door 164 is formed so as to be opposed to these.

On the side face 102 side, the doors 162 and 163 are formed so as to shield the housing spaces A and B respectively when the door is closed.

On the other hand, the door 164 is installed so as to shield the entire housing space C, that is, the housing spaces A and B in a straddling state when the door is closed.

The shelf plate 161 is designed to be movable as described above, and when moved to the horizontal position to form a shelf, the space inside the housing box is partitioned into two of the housing spaces A and B so that articles can be individually stored into the respective housing spaces A and B.

On the other hand, when the shelf plate 161 is moved to cancel the partitions to form a single (housing space C) housing space in the housing box, even a large size or long size article can be housed.

Figure 6:
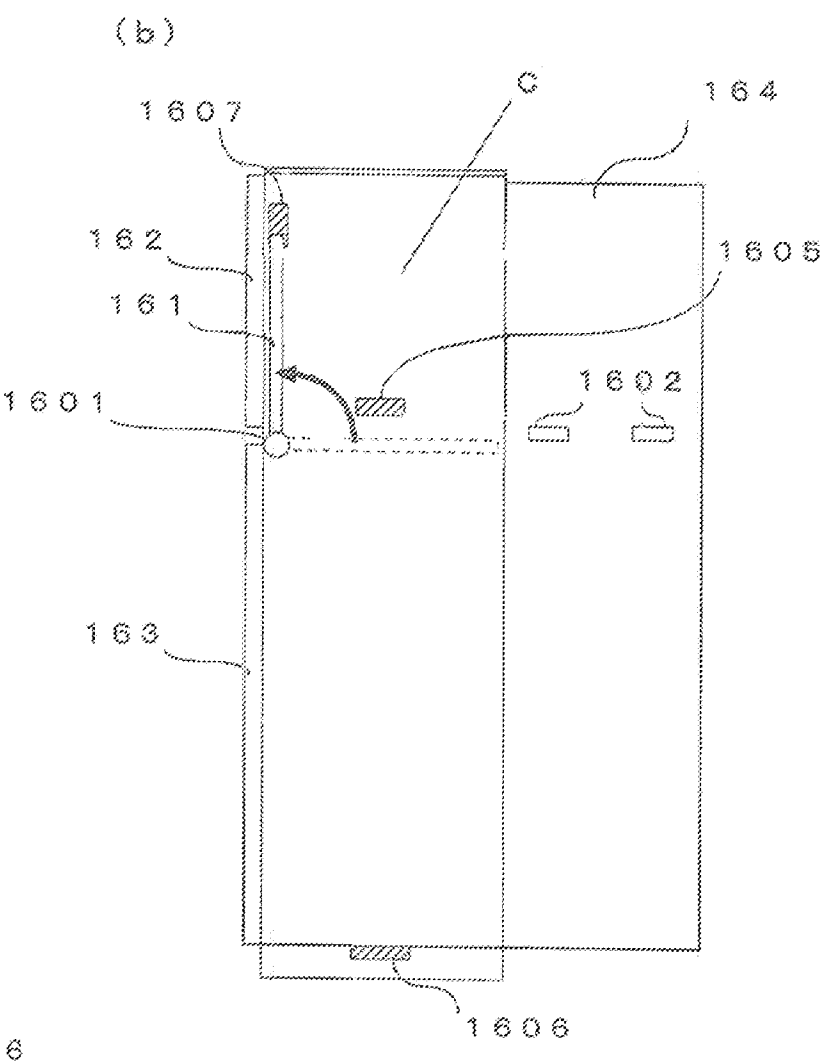
FIG. 6 is a drawing that shows one example of a moving mechanism of a shelf plate in the first embodiment of the present invention.
Figure 6:
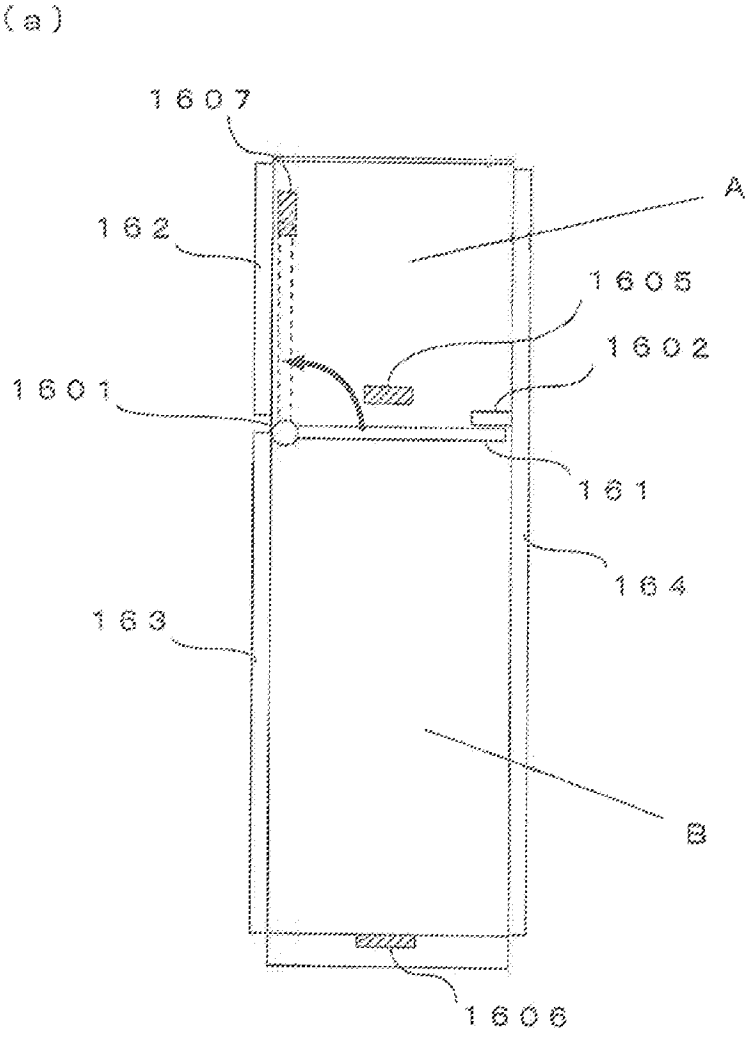

FIG. 6 is a drawing that shows one example of a moving mechanism of the shelf plate 161 in the first embodiment of the present invention, and FIG. 3 is a cross-sectional view taken along line X-X when seen from the front side of the housing device 10 of FIG. 3.

In the present drawing, the illustration of the post part 17 is omitted.

In the drawings, FIG. 6(*a*) shows a state in which the shelf plate 161 is used for partitioning so that the housing spaces A and B are formed, and FIG. 6(*b*) shows a state in which the shelf plate 161 is pivoted upward to cancel the partitions, thereby forming the housing space C.

In the examples shown in the drawings, the shelf plate 161 is attached through a hinge part 1601 interposed therebetween so as to pivot toward the front face 101 side and the back surface 104 side.

By pivoting the movable shelf plate 161 upward (in FIG. 6, by 90° in the anticlockwise direction when seen from front side) around the hinge part 1601 serving as the axis, the shelf plate 161 is raised so as to be overlapped with the door 162, the partitioned housing spaces A and B are released so that one housing space C having a joined volume of the housing spaces A and B is formed.

Moreover, although not illustrated in the drawings, the shelf plate 161 is provided with a configuration that regulates a pivotal movement downward from the horizontal direction, and allows a pivotal movement only in an upward direction, with for example, a member that is fixed to the front face 101 side and the back face 104 side so as to support one portion of the shelf plate 161.

In the housing part 16, a movement regulating part 1602 for regulating the movement of the shelf plate 161 by engaging with the shelf plate 161 is installed.

In the example of FIG. 6, the movement regulating part 1602 is installed on the back side (inner side) of the door 164 so as to protrude therein.

As shown in the drawing, when the door 164 is closed, the movement regulating part 1602 is located at a position to protrude toward the upper surface side of the shelf plate 161 so that the movement regulating part 1602 regulates the pivotal movement of the shelf plate 161 upward.

Even in the case when the doors 162 and 163 are opened so that the shelf plate 161 can be touched, if the door 164 is closed, the movement regulating part 1602 comes into contact with the upper surface of the shelf plate 161 to regulate its pivotal movement as described above; therefore, the housing spaces A and B are maintained without forming the housing space C.

Additionally, the altering method of the housing space of the housing box by the use of the above-mentioned shelf plate 161 and hinge part 1601 is only one example, and the present invention is not intended to be limited by this method. For example, an arrangement may be used in which not by moving the shelf plate 161, but by removing it, the partitions of the housing space can be canceled.

Moreover, the method for regulating the alteration of the housing space of the housing box by using the movement regulating part 1602 is only an example, and the present invention is not intended to be limited by this method.

The housing part 16 is provided with detection parts 1605 and 1606 for detecting articles respectively stored in the housing spaces A and B of the housing box, and a detection part 1607 for detecting the pivotal movement of the shelf plate 161 up to the vertical position.

The detection parts 1605 to 1607 are constituted by, for example, optical sensors of infrared rays or the like and weight sensors, or the like.

The detection parts 1605 to 1607, which are electrically connected to the control part 11, output signals indicating the results of detection to the control part 11.

Upon receipt of the inputted signal indicating the results of detection, the control part 11 can confirm (detect) that articles are stored in the respective housing spaces A and B or that the shelf plate 161 has been pivoted upward based upon the input signals.

The post part 17 is provided with a housing space for housing a mail object such as a postal card or the like, or a small-size or thin-type delivery object or the like.

The post part 17 has a post opening 171.

The post office entrepreneur and the delivery entrepreneur post a mail object or the like from the post opening 171.

The posted mail object or the like is stored in the housing space of the post part 17.

The post part 17 is provided with an opening part (not shown) for use in taking out the posted mail object or the like, and the opening part is shield by a door 172 that is lockable.

Moreover, the post part 17 is provided with a locking/unlocking part 175 in the same manner as in the housing part 16.

With respect to the configurations of the door 172 and the locking/unlocking part 175, the same configurations as those of the housing part 16 are used, the explanations thereof will be omitted.

A circuit housing part 18 is a box body that physically houses circuits for constituting the control part 11, the information storage part 12, the communication part 13, the display part 14 and the operation part 15.

As shown in FIG. 3, the circuit housing part 18 is collectively disposed on the front surface side of the housing device 10, and the space except for a space occupied by the circuit housing part 18 is assigned to the housing boxes and the post part 17 of the housing part 16; therefore, the housing spaces of the housing part 16 and the post part 17 can be efficiently maintained.

(b) Configurations of Information Storage Part 12 of Housing Device 10

Figure 7:
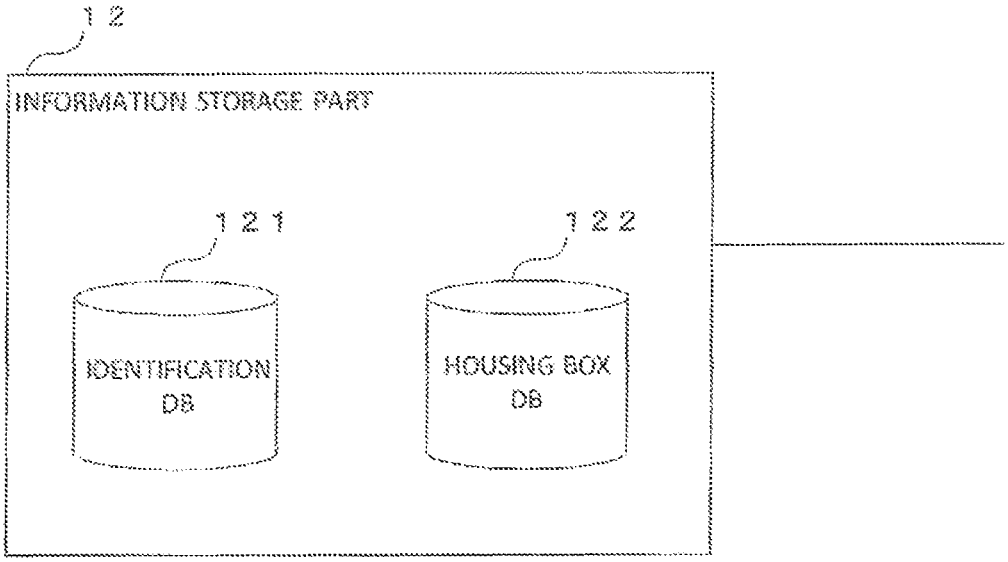
FIG. 7 is a drawing that shows respective data bases used by an information storage part of the housing device in the first embodiment of the present invention.

FIG. 7 shows data bases 121 and 122 used for storage by the information storage part 12 of the housing device 10 in accordance with the first embodiment of the present invention.

As shown in the drawing, the information storage part 12 of the housing device 10 stores identification DB (Data Base) 121 for managing identification information such as a password or the like that is needed upon unlocking the housing part 16, and a housing box DB (Data Base) 122 for managing the housing state of an article in the housing box and the movement state of the shelf plate 161.

FIG. 8 is a drawing that shows one example of a data configuration of identification DB 121 in accordance with the first embodiment of the present invention.

In the example shown in the drawing, the identification DB 121 manages identification information for unlocking the housing box in association with an identification ID (user ID) for identifying each of users (users and entrepreneurs of delivery agents).

When a user inputs a user ID and identification information or only the identification information by using the operation part 15, the operation part 15 outputs a signal indicating the inputted information to the control part 11.

The control part 11 collates the information indicated by the input signal from the operation part 15 with identification information or the like managed by the identification DB 121 so as to carry out an identifying process.

When the control part 11 determines that the identification is successful, it unlocks any one of the doors 162, 163 and 164 or some of them.

Moreover, as shown in the drawing, the identification DB 121 manages conditions that allow each user (user or entrepreneur) to unlock the housing box in association with the respective user ID's.

In the example of the drawing, with respect to "unlocking of unused housing space", it is permitted to all the users.

On the other hand, with respect to "unlocking of used housing space", it is permitted to different uses depending on the purpose of use at the time of storing an article in the housing space.

The following description will explain "unlocking of used housing space".

At the time of storing an article in the housing device 10, a user or an entrepreneur inputs its purpose of use by using the operation part 15.

For example, when an entrepreneur delivers a delivery object addressed to a user, and stores it in the housing device 10, it inputs "storing delivery object" as information indicating its purpose of use.

Moreover, when a user stores a delivery object to be sent to another person inside the housing device 10 so as to ask the delivery thereof, he or she inputs "request for delivery" as information indicating its purpose of use.

Furthermore, when a user puts laundry items inside the housing device 10 so as to ask for laundry, he or she inputs "request for laundry" as information indicating its purpose.

The identification DB 121 manages information of users capable of taking out in accordance with the above-mentioned purpose of use.

In the example of the drawing, "○" represents that unlocking is permitted at the time of the corresponding purpose of use, while "x" represents that unlocking is inhibited.

In the example of the drawing, in the identification DB 121, for a user ID "0001", all the purposes of use, "storing delivery object", "request for delivery" and "request for laundry" are set to "0"; therefore, it is indicated that the user with user ID "0001" can unlock the door of the housing space and take out the article when his or her purpose of use is "storing delivery object", "request for delivery" or "request for laundry".

On the other hand, in the identification DB 121, for a user ID "0002", only the purpose of use "request for delivery" is set to "0"; therefore, it is indicated that a delivery entrepreneur with user ID "0002" can unlock the door of the housing space only when his or her purpose of use is "request for delivery" and that in the case of another purpose of use, unlocking is not available.

By limiting the person capable of unlocking depending the purpose of use of the housing part 16, theft or the like of an article can be easily prevented.

In addition to the unlocking of the doors 162 to 164 of the housing part 16, as explained above, the identification DB 121 is also used for identifying process for unlocking the door 172 of the post part 17.

The unlocking of the door 172 of the post part 17 is permitted only for the user on principle.

When the user brings the identification medium 41 close to the operation part 15 or the like, the identification information or the like written in the identification medium 41 is inputted to the operation part 15.

A signal indicating the inputted identification information or the like is inputted from the operation part 15 into the control part 11.

The control part 11 collates the identification information or the like indicated by the input signal with identification information or the like managed by the identification DB 121 so as to carry out an identifying process.

When the control part 11 determines that the identification is successful as the results of the identifying process, it transmits an unlocking signal to the post part 17.

Upon receipt of the inputted unlocking signal, the post part 17 unlocks the door 172 by the locking/unlocking part.

FIG. 9 is a drawing that shows an example of data configuration of the housing box DB 122 in accordance with the first embodiment of the present invention.

The housing box DB 122 manages the housing state of a current housing box based upon the detection results by the respective detection parts 1605 to 1607.

Supposing that the stored states of an article by the respective detection parts 1605, 1606 and 1607 or the state in which the shelf plate 161 forms a shelf are indicated by "○", and that the state in which no article is housed or the state in which the shelf plate 161 has been pivoted upward to form a single housing space C is indicated by "x", the detection results of "○", "○", "○" in the detection parts 1605, 1606 and 1607 indicate that both of the housing spaces A and B have articles housed therein, and the detection results of "○", "x", "○" and the detection results of "x", "○", "○" respectively indicate that only the housing space A is in the stored state and that only the housing space B is in the stored state.

Moreover, the detection results of "○", "○", "x" in the detection parts 1605, 1606 and 1607 indicate that a large size or long size article is stored in the single housing space C that is not partitioned.

Furthermore, in the case when at least one of the housing spaces A and B houses an article, with the housing box DB 122 being in the "housed state", since the movement of the shelf plate 161 is regulated, with the result that no housing space C can be formed, the item of the housing space C in the housing box DB 122 is set to "unusable".

Furthermore, with respect to the housing space in use, the housing box DB 122 also manages "purpose of use" that is inputted at the time of storing an article therein.

In the example of the drawing, the purpose of use of the housing space A during "in housed state" is managed as "stored state of delivery object". With respect to the corresponding housing space A, only the user who is permitted to unlock in "storing delivery object" in the purpose of use in identification DB 121 can unlock.

Additionally, in the present example, the housing box DB 122 stores the purpose of use as described above; however, in place of, or in addition to this, the ID of a user who can unlock can be stored.

(2) Configuration of Managing Server 20

The managing server 20 is an information processing device for managing identification information for use in unlocking the housing device 10.

The managing server 20 is connected to the housing device 10 through the network 100.

Figure 10:
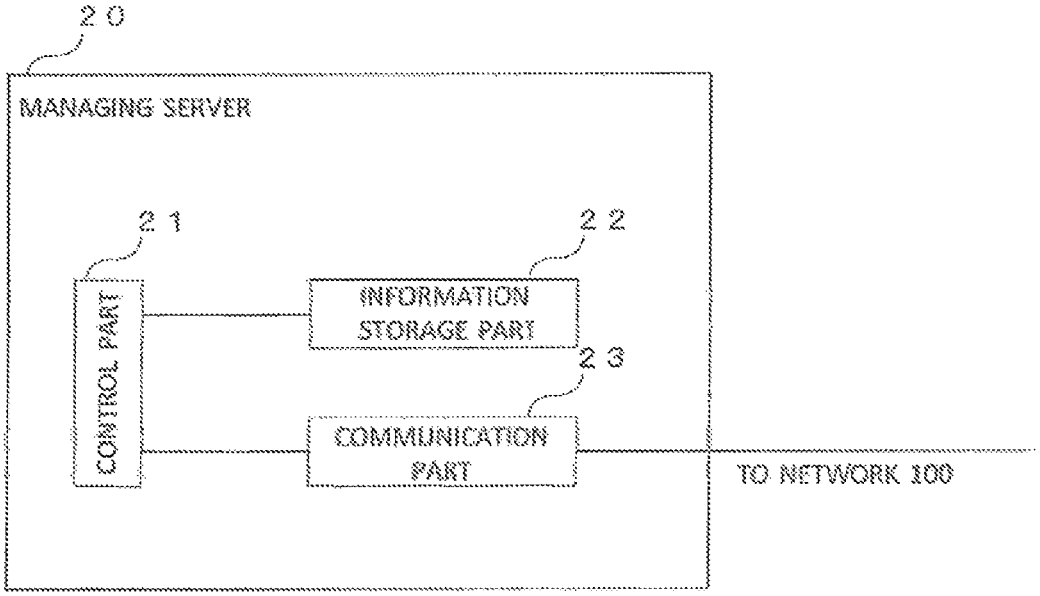
FIG. 10 is a drawing that shows a configuration of a managing server in the first embodiment of the present invention.

FIG. 10 is a drawing that shows a configuration of the managing server 20 in accordance with the first embodiment of the present invention.

As shown in the drawing, the managing server 20 is constituted by a control part 21 that is composed of a CPU or the like so as to control the entire managing server 20, an information storage part 22 for storing various pieces of information and a communication part 23 for carrying out communication with the housing device 10 through the network 100.

The respective parts 21 to 23 are connected to an inner bus, and through the bus, various pieces of information are inputted/outputted thereto/therefrom so that under the control of the control part 21, various processes are executed.

The control part 21, which is a processing part for controlling the entire managing server 20, is constituted by, for example, electronic circuits, such as a CPU (Central Processing Unit) or the like and integrated circuits, such as FPGA (Field-Programmable Gate Array) or the like.

The control part 21 executes reading processes of information from the information storage part 22 and also executes writing processes of information on the information storage part 22.

The information storage part 22 is a device for storing information, such as a hard disc, a memory, a semiconductor element, or the like.

The information storage part 22 is provided with a region for storing programs to be executed in the control part 21 and a work region (RAM, etc.) or the like that is temporarily used when the control part 21 executes processes, and stores data bases to be described later.

The control part 21 reads out a program stored in the information storage part 22 and develops it on the work region so as to execute various processes.

The communication part 23 corresponds to an interface for controlling communications with the housing device 10 through the network 100, and is provided with a LAN adopter or the like.

The communication part 23 may have a wireless transmitter/receiver, and may be connected to the LAN, Internet or the like through wireless communication, or may be connected thereto through a wire such as a cable or the like.

Figure 11:
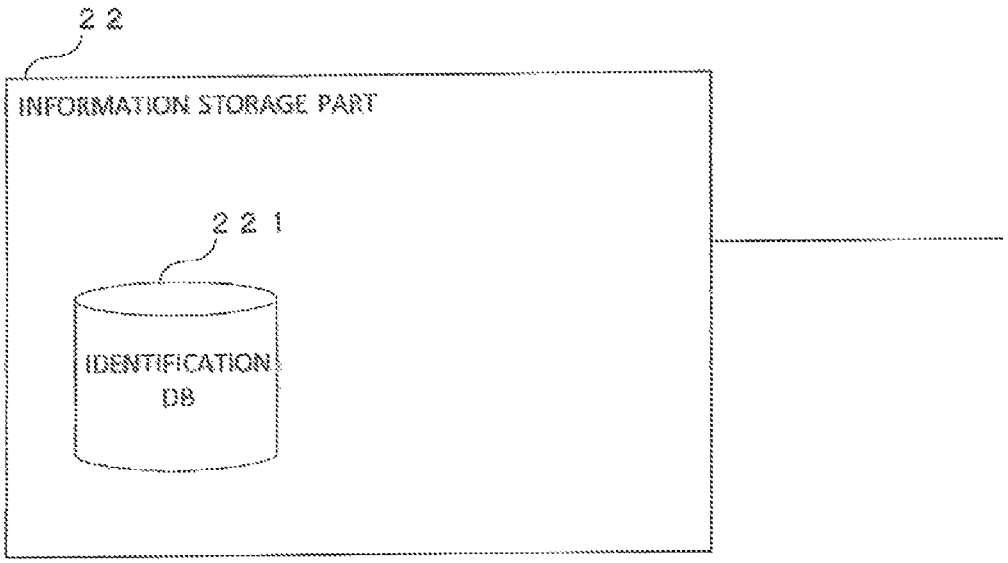
FIG. 11 is a drawing that shows a data base used by an information storage part of the managing server in the first embodiment of the present invention.

FIG. 11 is a drawing that shows a data base 221 used for storing data by the information storage part 22 of the managing server 20 in accordance with the first embodiment of the present invention.

As shown in the drawing, the information storage part 22 stores an identification DB 221 for managing identification information, such as a password or the like required upon unlocking the housing part 16.

Respective pieces of information managed by identification DB 121 and 221, which are communicated between the housing device 10 and the managing server 20 so as to be synchronous with the latest contents. That is, pieces of information between the identification DB 121 and DB 221 are made synchronous with each other so as to be updated to the latest information.

(3) Configurations of Identification Media 41 and 42

Identification media 41 and 42 may be prepared as, for example, a medium such as an IC card on which identification information is recorded, for example, magnetically, magneto-optically, or electrically on a memory or the like, or an electronic apparatus (portable terminal or the like) or the like, or may be a medium formed by printing or forming character information or code information on its surface.

The identification media 41 and 42 input identification information or the like recorded on its surface into the housing device 10 by using short-distance wireless communication or the like, such as, for example, infrared ray or the like.

Additionally, the recording system for information of the identification media 41 and 42 and the reading system for allowing the housing device 10 to read out information of the identification media 41 and 42 are not particularly limited, and any prior-art techniques conventionally known may be adopted.

The identification medium 41 is an information recording medium possessed by a user, and has identification information for unlocking the housing box of the housing device 10 and the user ID for the corresponding user recorded thereon.

The identification medium 41 may be an IC card dedicatedly used for the housing device 10 or may be, for example, a traffic-based general-use IC card capable of being used for other usages or a portable terminal.

For example, the user brings the identification medium 41 close to the operation part 15 of the housing device 10 by, for example, holding it thereover so as to allow the operation part 15 of the housing device 10 to read the identification information recorded on the identification medium 41 by using short-distance infrared ray communication or the like so that the identification information is inputted to the housing device 10.

The housing device 10 carries out an identifying process based upon the above-mentioned inputted identification information, and when the identifying process is successful, unlocks the door of the housing box so that the user is allowed to take out an article from the unlocked housing box or to store an article therein.

For example, the user is allowed to take out a delivery object addressed to him or her or laundered clothes or the like, which has been stored in the housing box by an entrepreneur, or to store an object desired to be delivered to another person or clothes as laundry items therein.

The identification medium 42 is an information recording medium possessed by an entrepreneur.

The entrepreneur is a delivery entrepreneur (including postal entrepreneur) for delivering a delivery object addressed to a user to the housing device 10, a laundry entrepreneur or an entrepreneur of a retail store, such as a network supermarket or the like for delivering commodities purchased by a user.

The identification medium 42 may be an IC card dedicatedly used for the housing device 10 or may be, for example, a traffic-based general-use IC card capable of being used for other usages or a portable terminal.

On the identification medium 42, identification information for the entrepreneur and a user ID for the corresponding entrepreneur.

For example, the entrepreneur brings the identification medium 42 close to the operation part 15 of the housing device 10 by, for example, holding it thereover so as to allow the operation part 15 of the housing device 10 to read the identification information recorded on the identification medium 42 by using short-distance wireless communication or the like so that the identification information is inputted to the housing device 10.

The housing device 10 carries out an identifying process based upon the above-mentioned inputted identification information, and when the identifying process is successful, unlocks the door of the housing box of the housing device 10.

(1) Operations at the Time of Storing Article.

Figure 12:
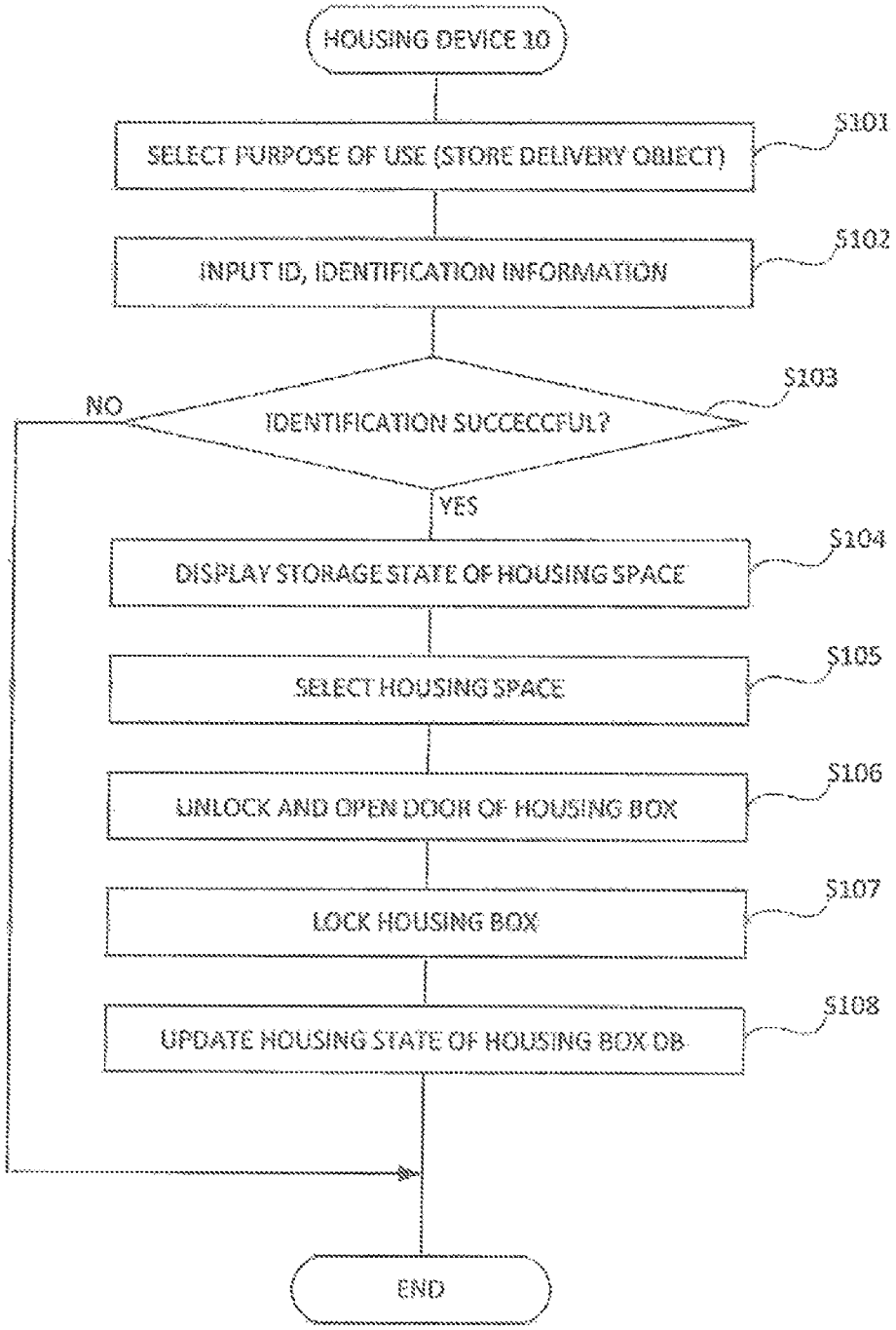
FIG. 12 is a flow chart showing a flow of operations by the housing device at the time of storing an article in the housing device in the first embodiment of the present invention.

FIG. 12 is a flow chart showing a flow of operations by the housing device 10 at the time of storing an article in the housing device 10 in accordance with the first embodiment of the present invention.

Referring to the present drawing, explanation will be given to operations, for example, at the time when an entrepreneur stores a delivery object addressed to a user in the housing device 10.

First, the entrepreneur visits an installation place of the housing device 10 at the entrance or the like of an individual house with a delivery object addressed to a user.

The entrepreneur selects "storing delivery object" as the purpose of use for the housing device 10 by using the operation part 15 of the housing device 10 (step S101).

The operation part 15 outputs a signal indicating the selection of "storing delivery object" to the control part 11. Upon receipt of the inputted signal, the control part 11 outputs a control signal such as for allowing a transmission of a wireless signal for starting an identifying process to the operation part 15.

Upon receipt of the above-mentioned control signal, the operation part 15 transmits a wireless signal based upon the control signal toward the outside of the housing device 10.

Moreover, the entrepreneur brings the identification medium 42 close to the operation part 15, for example, by holding it thereover for identification.

Then, the operation part 15 of the housing device 10 reads out the user ID and identification information written on the identification medium 42 (step S102).

That is, upon receipt of the wireless signal transmitted from the operation part 15, the identification medium 42 transmits a wireless signal including the user ID and identification information written on the medium itself to the outside. By receiving the wireless signal transmitted from the identification medium 42, the operation part 15 reads out the user ID and identification information written on the identification medium 42.

A signal indicating the user ID and identification information thus read is inputted to the control part 11.

Upon receipt of the inputted signal indicating the user ID and identification information, the control part 11 refers to the identification DB 121, and determines whether or not the corresponding user ID and the identification information are stored in a mutually associated state in the identification DB 121 (step S103).

In the case when these are not stored in the identification DB 121 in the mutually associated state (step S103/No), the control part 11 determines that the identification has failed, thereby completing the operations without unlocking the housing box.

On the other hand, in the case when these are stored in the identification DB 121 in the mutually associated state (step S103/Yes), the control part 11 determines that the identification has been successful, and refers to the housing box DB 122 to detect the storing states of the housing spaces A, B and C, and outputs a signal indicating the results of the detection to the display part 14 so that the housing states in the respective housing spaces are displayed thereon (step S104).

Next, the entrepreneur confirms the housing states of the respective housing spaces displayed on the display part 14, and selects a housing space capable of housing the delivery object to be delivered at this time among the housing spaces that are not currently used by using the operation part 15 (step S105).

The operation part 15 outputs a signal indicating the selected housing space to the control part 11.

Upon receipt of the corresponding inputted signal, the control part 11 outputs a signal for unlocking the door corresponding to the selected housing space to the housing part 16, thereby unlocking and opening the door (step S106).

At this time, the door of the corresponding housing box may be automatically opened at the time of unlocking.

In this case, when the entrepreneur selects either of the housing spaces A and B, the door (door 162 or door 163) for shielding the selected housing space is unlocked and opened so that the entrepreneur stores an article into the housing space that is opened.

On the other hand, when the entrepreneur selects the housing space C, the door 164 for shielding the selected housing space C is unlocked and opened. When the entrepreneur allows the shelf plate 161 to pivot upward to the vertical position, the partition between the housing spaces A and B is canceled to form the housing space C. The entrepreneur stores an article into the housing space C thus formed.

The entrepreneur closes the door of the housing box after storing the delivery object.

When the housing box is closed, the housing part 16 locks the housing box (step S107).

The detection part 1607 detects that the shelf plate 161 is pivoted up to the vertical position to form the housing space C, generates a detection signal indicating the detection results, and outputs the signal to the control part 11.

The detection part 1605 detects an article housed in the housing space A, and the detection part 1606 detects an article housed in the housing space B.

Moreover, the detection part 1605 and the detection part 1606 detect an article housed in the housing space C.

The detection part 1606 disposed on the bottom part of the housing space C detects the fact that an article is housed in the housing space C, generates a detection signal indicating the results of the detection and outputs the signal to the control part 11.

In the case when a housed article has a size that reaches the vicinity of the horizontal position of the detection part 1605, the detection part 1605 disposed on an upper portion of the side face of the housing space C detects that the article has stored in the housing space C, generates a detection signal indicating the results of the detection, and outputs the resulting signal to the control part 11.

Next, based upon the detection results of the detection signal inputted from the detection parts 1605 to 1607, the control part 11 updates the housing state of the housing space in the housing box DB 122, and based upon the fact that "storing delivery object" is selected in step S101, "storing delivery object" is written as purpose of use in the item of the housing space in which the article is housed at this time in the housing box DB 122 (step S108).

By writing the purpose of use in the housing box DB 122 in this manner, the article stored in the housing space at this time can be taken out only by the user whose "purpose of use" is permitted (in this case, user) in the identification DB 121.

In the manner as described above, operations are completed.

As explained above, upon storing an article such as a delivery object in the housing device 10, the entrepreneur can select a housing space that is suitable for the size of the delivery object among housing spaces having a plurality of sizes, thereby making it possible to effectively use the housing spaces.

Additionally, explanation has been given by exemplifying a case in which an entrepreneur stores a delivery object addressed to a user in the housing device 10; however, this arrangement may also be applied to a case in which a user tries to store a delivery object for another person or an article such as clothes as laundry items in the housing device 10.

In this case, in step S101, a user selects "request for delivery" or "request for laundry" or the like as purpose of use of the housing device 10 by using the operation part 15.

Moreover, in the case when "request for delivery" is selected as the purpose of use, the control part 11 writes the corresponding purpose of use "request for delivery" in the item of the housing space in which the article is housed at this time in the housing box DB 122 in step S108.

Furthermore, in the case when "request for laundry" is selected as the purpose of use, the control part 11 writes the corresponding purpose of use "request for laundry" in the item of the housing space in which the article is stored at this time in the housing box DB 122.

In this case, in the case when a user stores an article in the housing device 10, the selected purpose of use is written in the housing box DB 122 in this manner, and the article stored in the housing space at this time cannot be taken out by a person except for the user who is permitted to unlock the housing space in which the article is stored by the purpose of use.

(2) Operations at the Time of Taking Out Article

After an entrepreneur has stored an article in a housing box in the housing device 10, a user takes the article out of the housing box.

Figure 13:
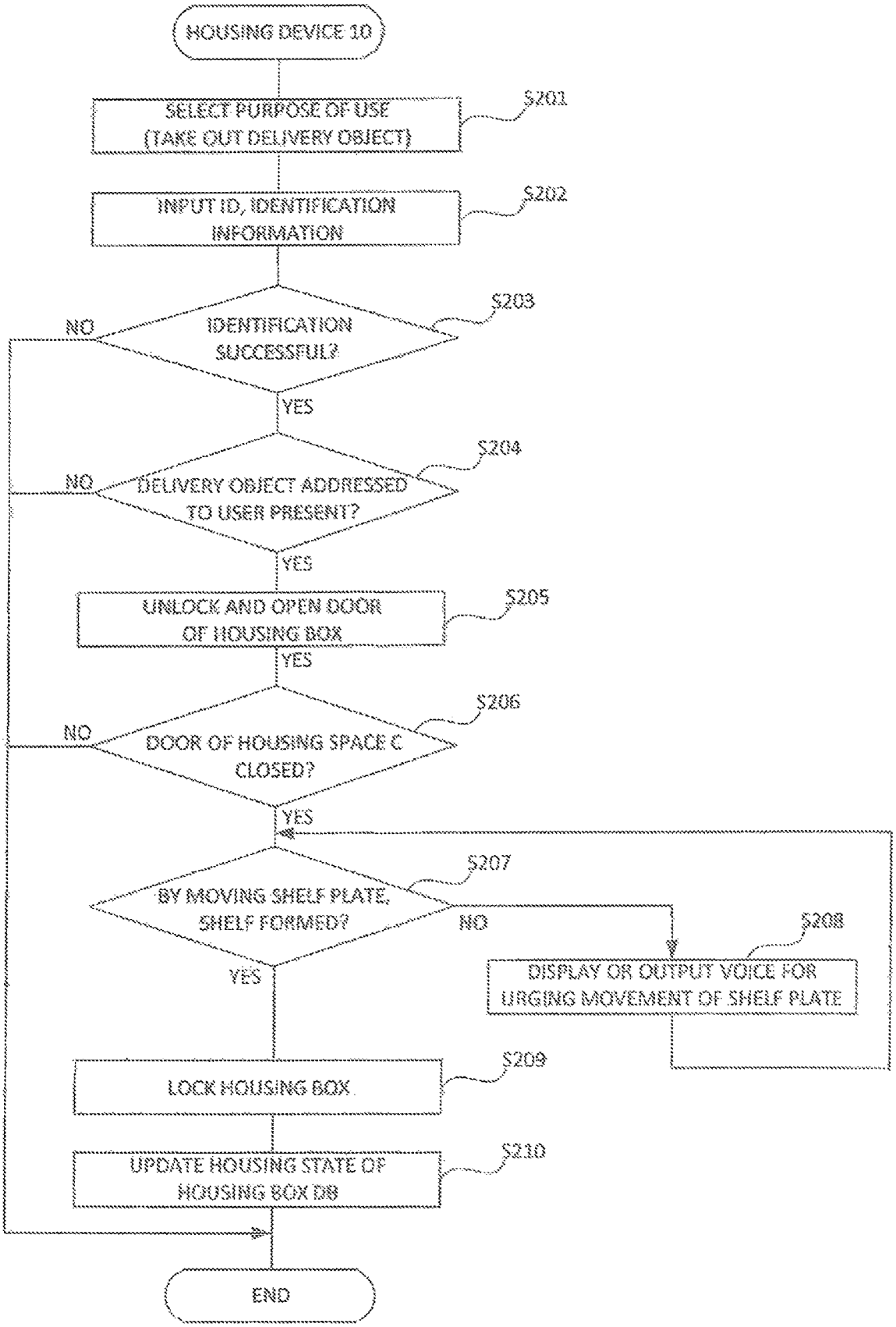
FIG. 13 is a flow chart showing a flow of operations by the housing device at the time of taking out an article from the housing device in the first embodiment of the present invention.

FIG. 13 is a flow chart showing a flow of operations by the housing device 10 at the time of taking out an article from the housing device 10 in accordance with the first embodiment of the present invention.

Referring to the present drawing, explanation will be given to operations, for example, at the time when a user takes out the delivery object addressed to the user that was stored therein by an entrepreneur from the housing device 10.

First, the user visits an installation place of the housing device 10.

The user selects "taking out delivery object" as the purpose of use for the housing device 10 by using the operation part 15 of the housing device 10 (step S201).

The operation part 15 outputs a signal indicating the selection of the above-mentioned "taking out delivery object" to the control part 11.

Upon receipt of the above-mentioned inputted signal, the control part 11 outputs a control signal such as for allowing a transmission of a wireless signal for starting an identifying process to the operation part 15.

Upon receipt of the above-mentioned inputted signal, the operation part 15 transmits a wireless signal based upon the control signal toward the outside of the housing device 10.

The user brings the identification medium 41 close to the operation part 15 of the housing device 10 by, for example, holding it thereover for identification.

Then, the operation part 15 of the housing device 10 reads the user ID and identification information written on the identification medium 41 (step S202).

That is, upon receipt of a wireless signal transmitted from the operation part 15, the identification medium 41 transmits a wireless signal including the user ID and identification information written on its own surface to the outside. By receiving the wireless signal transmitted from the identification medium 41, the operation part 15 reads out the user ID and identification information written on the identification medium 41.

The signal indicating the user ID and identification information thus read is inputted to the control part 11.

Upon receipt of the input signal indicating the above-mentioned user ID and identification information, the control part 11 refers to the identification DB 121, and determines whether or not the corresponding user ID and the identification information are stored in a mutually associated state in the identification DB 121 (step S203).

In the case when these are not stored in the mutually associated state in the identification DB 121 (step S203/No), the control part 11 determines that the identification has failed, thereby completing the operations without unlocking the housing box.

On the other hand, in the case when these are stored in the identification DB 121 in the mutually associated state (step S203/Yes), the control part 11 determines that the identification has been successful, and refers to the housing box DB 122 to determine whether or not there is any item of the housing space associated with its purpose of use that allows the user to unlock in the identification DB 121 among items of housing spaces in which an article is housed (step S204).

Here, in the case when in the housing box DB 122, there is no item of the housing space associated with its purpose of use that allows the user to unlock (step S204/No), the control part 11 determines that no delivery object addressed to the user is stored in the housing device 10, thereby completing operations, without unlocking the housing box.

On the other hand, in the case when in the housing box DB 122, there is an item of the housing space associated with its purpose of use that allows the user to unlock (step S204/Yes), the control part 11 outputs an unlocking signal for a door that shields the housing space indicated by the corresponding item to the housing part 16, thereby unlocking the door to be opened (step S205).

At this time, the door of the corresponding housing box may be automatically unlocked and also opened.

In this case, when the housing spaces indicated by the above-mentioned items correspond to housing spaces A, B and C, the locking/unlocking part 165 unlocks the respective doors 162, 163 and 164 so as to be opened.

That is, in the case when the detection parts 1605, 1606 and 1607 detect that a delivery object addressed to a user is stored in the housing space A, the locking/unlocking part 165 unlocks only the door 162 based upon an unlocking signal from the control part 11, in the case when they detect that a delivery object addressed to a user is stored in the housing space B, the locking/unlocking part 165 unlocks only the door 163 based upon an unlocking signal from the control part 11, and in the case when they detect that a delivery object addressed to a user is stored in the housing space C, the locking/unlocking part 165 unlocks only the door 164 based upon an unlocking signal from the control part 11.

When the doors 162 and 163 of the housing spaces A and B are opened, the user takes out delivery objects addressed to himself or herself from the housing spaces A and B, and then, closes the doors (step S206/Yes).

On the other hand, in the case when the door 164 of the housing space C is opened, the user takes out a delivery object addressed to himself or herself from the housing space C, and after allowing the shelf plate 161 to pivot to the horizontal position on the lower front side (door 164 side) so that the shelf is formed, the door is closed (step S206/No).

In this case, in the case when without allowing the shelf plate 161 to pivot onto the lower front side, the user closes the door 164 (step S207/No), the detection part 1607 detects the fact that the shelf plate 161 is still in the vertical position, outputs a detection signal indicating the detection result to the control part 11.

Upon receipt of the above-mentioned detection signal, the control part 11 displays a message or the like urging that "by allowing the shelf plate 161 to pivot onto the downward front side, the shelf is formed" on the display part 14 or outputs a voice from a speaker or the like, not shown (step S208).

Moreover, at this time, the control part 11 may output an unlocking signal to the housing part 16 so as to automatically unlock.

By confirming the above-mentioned message or the like, the user unlocks the housing part 16, and after forming the shelf by allowing the shelf plate 161 to pivot onto the lower front side (door 164 side), closes the door.

When the door of the housing box is closed, the housing part 16 locks the housing box (step S209).

For example, in the case when a delivery object has been taken out from the housing space C, since the shelf plate 161 is allowed to pivot in the horizontal position onto the lower front side so that the housing spaces A and B are formed, the detection part 1607 neither generates the detection signal indicating that the shelf plate 161 is in the vertical position, nor outputs it to the control part 11.

Since no article is stored in the housing spaces A and B thus formed, the detection parts 1605 and 1606 detect nothing.

Next, in accordance with the detection signal from the detection parts 1605 to 1607 or based upon no input of the detection signal, the control part 11 updates the housing state of the housing space in the housing box DB 122, and omits the purpose of use from the item of the housing space from which the above-mentioned article has been taken out (step S210).

For example, in the case when a delivery object has been taken out from the housing space C, based upon the fact that no detection signals are inputted from the detection parts 1605 to 1607 after closing the doors 162, 163 and 164, the housing state of the housing space in the housing box DB 122 is updated to "unhoused", the purpose of use is omitted from the item of the housing space from which the above-mentioned article has been taken out.

By omitting the purpose of use from the housing box DB 122 in this manner, the housing space from which the article has been taken out at this time thereafter becomes available for storage.

Thus, the operations are completed.

Additionally, explanation has been given by exemplifying a case in which a user takes out a delivery object addressed to himself or herself from the housing device 10; however, this arrangement can be applied to a case in which an entrepreneur takes out an article housed by a user from the housing device 10.

For example, in the case when with respect to the article stored in the housing device 10, "request for delivery" is written in the item of the housing box DB 122 as its purpose of use, at the time of identification for unlocking the housing box door, a delivery entrepreneur can unlock the corresponding door by inputting the identification information or the like of the delivery entrepreneur.

Moreover, in the case when with respect to the article stored in the housing device 10, "request for laundry" is written in the item of the housing box DB 122 as its purpose of use, at the time of identification for unlocking the housing box door, a laundry entrepreneur can unlock the corresponding door by inputting the identification information or the like of the laundry entrepreneur.

As explained above, in accordance with the housing system in the first embodiment of the present invention, since the housing device 10 is designed so that the display part 14 and the operation part 15 are disposed on a surface different from the surface on which the doors 162 to 164 of the housing box are disposed, the areas for the housing box doors and the opening parts can be made larger to ensure a sufficient housing area so that even a large size or long size article can be housed.

In accordance with the housing system in the first embodiment of the present invention, since the housing device 10 is designed such that a movable shelf plate (shelf plate 161) for partitioning the housing box into a plurality of housing spaces (for example, housing spaces A and B) is provided, and when a large size or long size article is stored in the housing box, by moving the above-mentioned shelf plate 161 to cancel the corresponding partition, a housing space (housing space C) is formed by combining the plural housing spaces (housing spaces A and B) so that it becomes possible to efficiently house articles of various sizes.

In accordance with the first embodiment of the present invention, the housing system is provided with doors (doors 162 and 163) for shielding the above-mentioned plural housing spaces (housing spaces A and B) and a door (door 164) for shielding the housing space (housing space C) formed by canceling the above-mentioned partition, which are individually installed; therefore, while the housing space in which an article has been housed is shielded, as it is, an unhoused housing space can be efficiently utilized.

In accordance with the housing system in the first embodiment of the present invention, since the housing device 10 is designed such that the above-mentioned shelf plate (shelf plate 161) can be moved only when the door (door 164) that shields the entire housing space (housing space C) in which the above-mentioned partition is canceled is opened; therefore, it is possible to regulate the shelf plate 161 from moving when an article is stored in the partitioned housing spaces (housing spaces A and B) and consequently to prevent troubles, for example, the article put on the shelf plate from falling down.

In accordance with the housing system of the first embodiment of the present invention, different from a conventional home delivery locker, the housing device 10 is installed on the ground or a floor so as to rise itself therefrom, without fixing onto a wall or the like of a house; therefore, in comparison with a conventional home delivery locker fixed onto a wall, the surface to be fixed can be freely used so that the degree of freedom in designing the housing device 10 can be improved.

As in the case of the present embodiment, on the surface that becomes to be freely used, a door of the housing box may be formed. As a result, as shown in the present embodiment, the housing space can be effectively utilized.

Moreover, as described above, since the housing device 10 in the present embodiment is the housing device of the self standing type, without being fixed onto the wall, different from the conventional home delivery locker that is fixed onto the wall, it can be additionally installed after a building such as a house or the like has been built.

Additionally, the above-mentioned embodiments are merely examples of desirable embodiments of the present invention, and the embodiments of the present invention are not intended to be limited thereby, and various modifications may be made therein within the scope without departing from the gist of the present invention.

Figure 14:
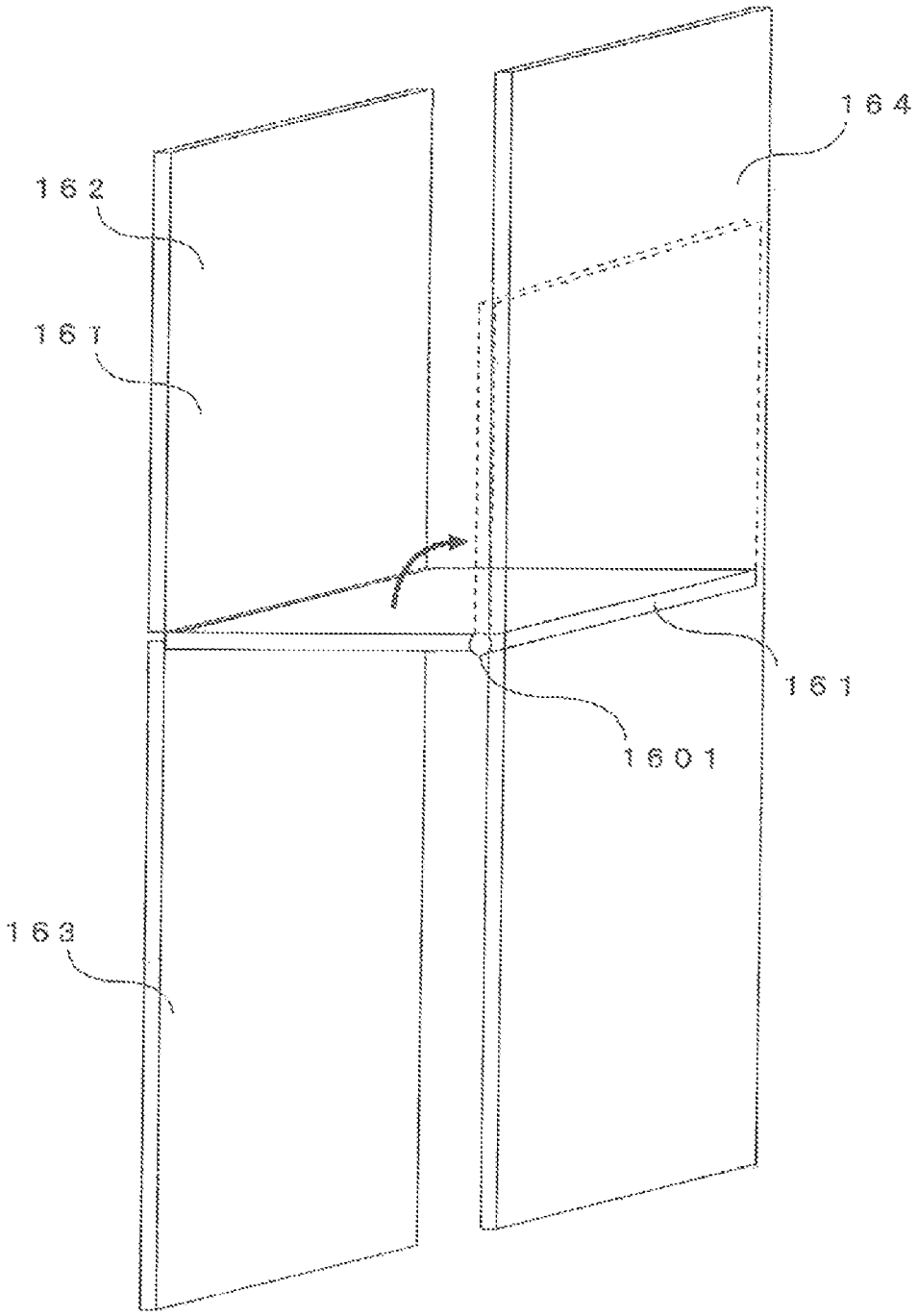
FIG. 14 is a drawing that shows a configuration of a housing part in a modified example in the first embodiment of the present invention.

FIG. 14 is a drawing that shows a configuration of a housing part 16 in accordance with a modified example of the first embodiment of the present invention.

In the example shown in FIG. 5, by pivoting the movable shelf plate 161 upward around the hinge part 1601 serving as the axis, since the shelf plate 161 is raised so as to be overlapped with the door 162, the partitioned housing spaces A and B are released so that one housing space C is formed.

In contrast, in the example shown in FIG. 14, by pivoting the movable shelf plate 161 upward around the hinge part 1601 serving as the axis, since the shelf plate 161 is raised so as to be overlapped with a door 164, the partitioned housing spaces A and B are released so that one housing space C is formed.

Moreover, not limited by the examples of FIGS. 5 and 14, the shelf plate 161 may be moved in any of directions and positions so that the housing space C can be formed.

Figure 15:
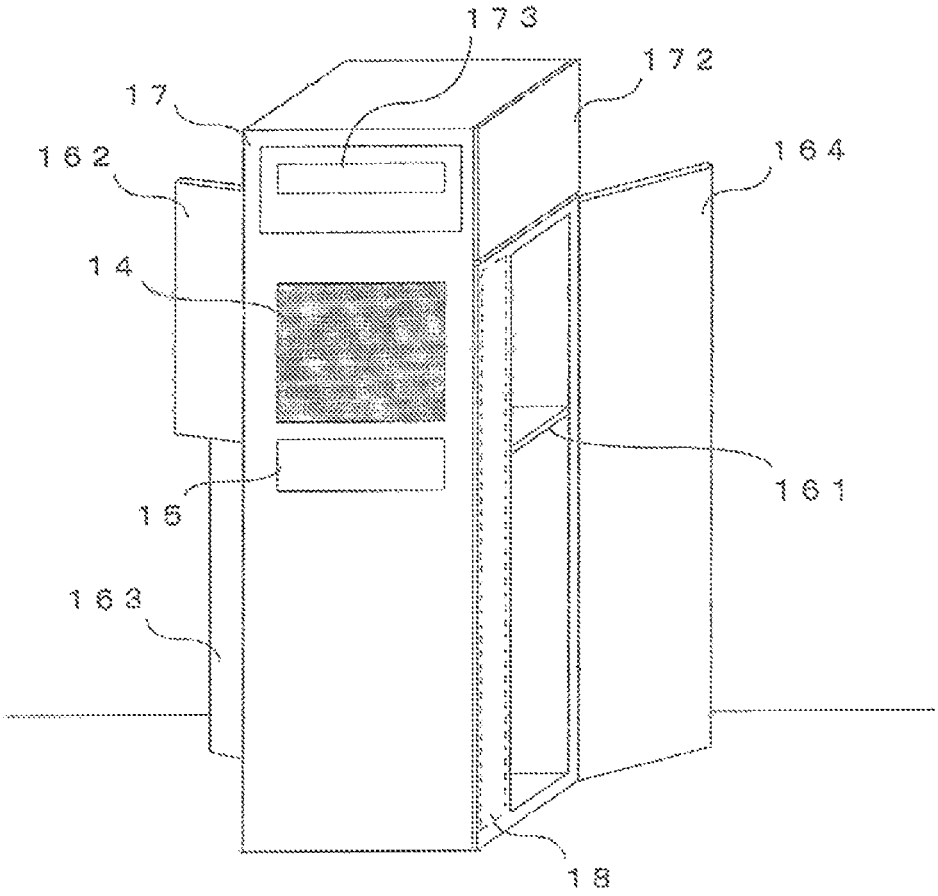
FIG. 15 is a drawing that shows an appearance of a housing device in the modified example in the first embodiment of the present invention.

FIG. 15 is a drawing that shows an appearance of a housing device 10 in accordance with another modified example of the first embodiment of the present invention.

In the above-explained first embodiment, the post opening 171 and the door 172 of the post part 17 are formed on the same side as that of the door 164; however, for example, as shown in FIG. 15, these may be installed on the front side where the display part 14 and the operation part 15 are installed.

In the above-explained first embodiment of the first invention, the shelf plate 161 is installed so as to pivot around the hinge part 1601, and by pivoting the shelf plate 161 upward to a recessed portion when seen from the door 164 side, the position of the shelf plate 161 is moved so as to be overlapped with the door 162 so that the partition between the housing spaces A and B is canceled to form the housing space C.

However, the configuration for realizing the movement of the shelf plate 161 at the time of canceling the partitions of the housing spaces A and B is not intended to be limited by the above-mentioned embodiment, and it can be realized by using any other configurations.

For example, by installing the shelf plate 161 onto a rail installed so as to stand in the vertical direction in a manner so as to be movable in the upper and lower vertical directions, and by allowing the shelf plate 161 to slide upward or downward along the rail, while the shaft plate 161 and the ground being maintained in parallel with each other, the partitions between the housing spaces A and B may be canceled.

In the housing device 10 in the above-mentioned first embodiment, a movement regulating part 1602 is formed on the back side (housing inner side) of the door 164 so as to protrude therefrom, and in the case when the door 164 is closed, the above-mentioned movement regulating part 1602 is at such a position as to protrude onto the upper surface side of the shelf plate 161 so that the movement regulating part 1602 regulates the pivotal movement upward of the shelf plate 161.

In contrast, in the housing device 10 in accordance with the second embodiment of the present invention, the movement regulating part is formed into a hook shape, and the tip part thereof is engaged with an engaging part inside a groove part formed on the bottom surface side of the shelf plate 161 so that the movement of the shelf plate 161 is regulated.

The following explanation will be given on the premise that the configuration and operations in the second embodiment of the present invention are the same as those of the first embodiment or the modified example thereof, unless otherwise specified.

Figure 16:
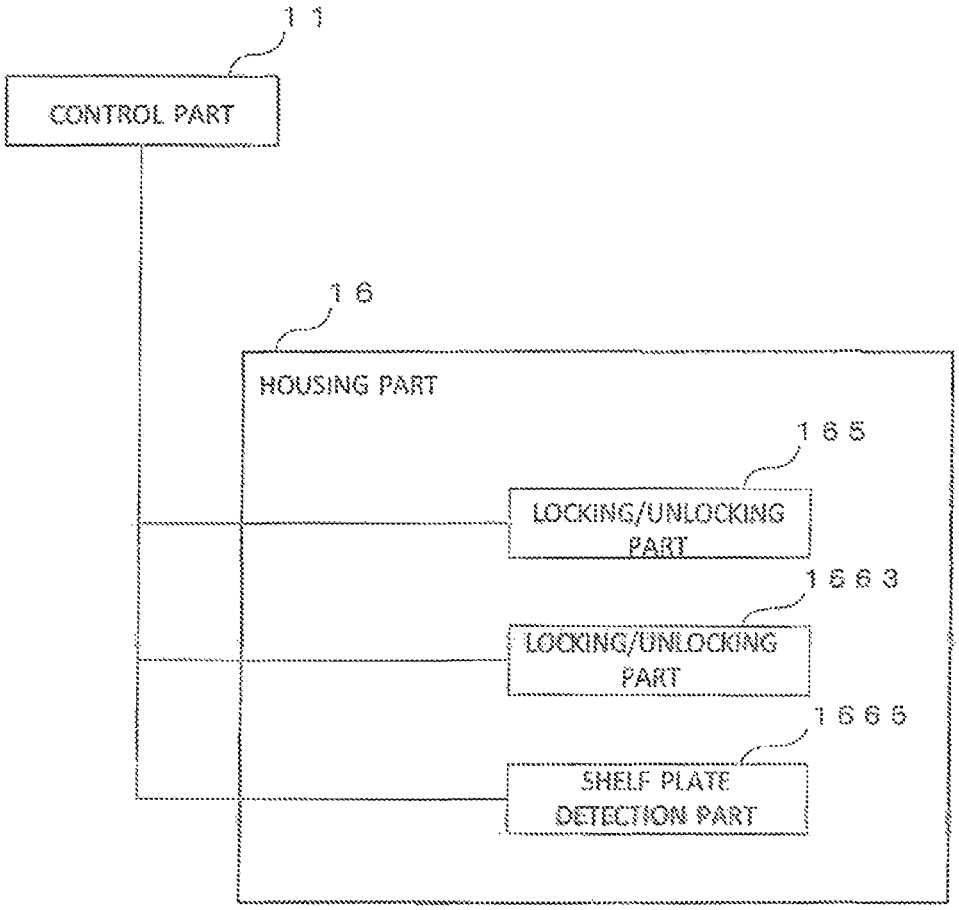
FIG. 16 is a drawing that shows an electrical connection between a control part and a housing part in a housing device in a second embodiment of the present invention.

FIG. 16 is a drawing that shows electrical connection between the control part 11 and the housing part 16 in the housing device 10 in the second embodiment of the present invention.

As shown in the drawing, the housing part 16 is provided with the aforementioned locking/unlocking part 165 for carrying out locking/unlocking processes on the respective doors 162 to 164 and driving sources, such as electric motors or the like, and has a locking/unlocking part 1663 for carrying out locking/unlocking processes of the shelf plate 161 by moving a movement regulating part 1661 to be described later and a shelf plate detection part 1665 for detecting the fact that the shelf plate 161 is in the horizontal position.

These locking/unlocking parts 165 and 1663 are electrically connected to the control part 11 and operated by a control signal outputted from the control part 11.

Moreover, the shelf plate detection part 1665 outputs a detection signal indicating the fact that the shelf plate 161 has moved to the horizontal position to the control part 11.

In the same manner as in the first embodiment, upon receipt of a control signal (unlocking signal) outputted from the control part 11, the locking/unlocking part 165 carries out the unlocking process on the corresponding door based upon the corresponding control signal.

Upon receipt of the control signal outputted from the control part 11, the locking/unlocking part 1663 drives a power source, such as the above-mentioned electric motor or the like, and by using a pivotal axis 1662 to be described later connected thereto, the movement regulating part 1661 is pivoted around the pivotal axis 1662.

When the shelf plate detection part 1665 detects the fact that the shelf plate 161 has been moved to the horizontal position, it generates a detection signal indicating the fact that the shaft plate 161 has been moved to the horizontal position, and then continuously outputs the detection signal to the control part 11 until the signal has been no longer detected.

Upon receipt of the input of the detection signal, the control part 11 recognizes that the shelf plate 161 is located in the horizontal position, and when in this state, it recognizes that at least one of the housing spaces A and B stores a delivery object, it outputs a control signal to the locking/unlocking part 1663 so that by moving a movement regulating part 1661 to be described later, the shelf plate 161 is locked and the movement is regulated, with the shelf plate 161 being maintained in the horizontal position.

Moreover, in the case when the shelf plate 161 is not in the horizontal position, since the shelf plate detection part 1665 does not detect that the shelf plate 161 is in the horizontal state, it does not output the detection signal to the control part 11. In this case, the control part 11 does not output the control signal for locking the movement of the shelf plate 161 to the locking/unlocking part 1663.

Figure 17:
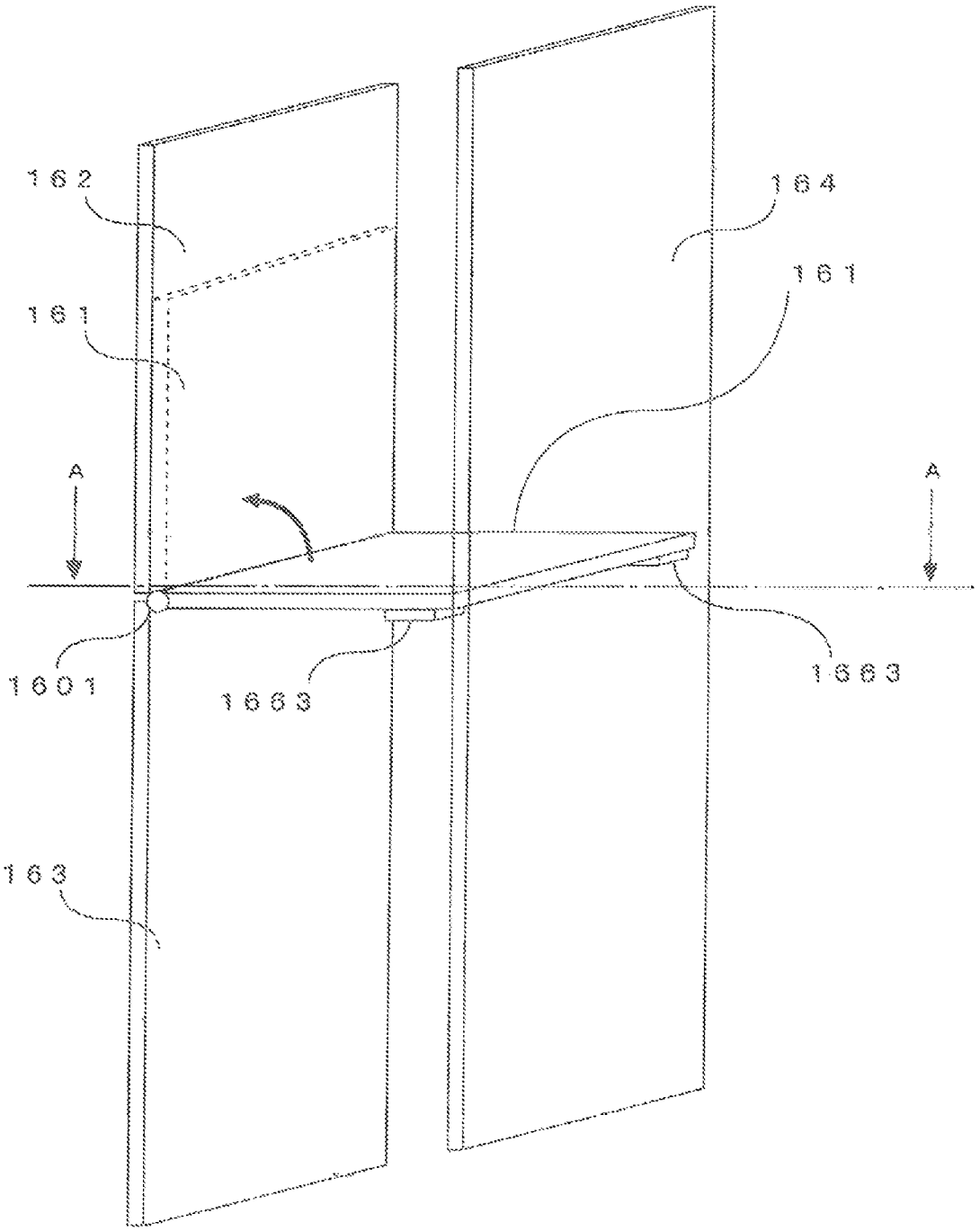
FIG. 17 is a drawing that shows a movement regulating structure of a shelf plate in accordance with the second embodiment of the present invention.

FIG. 17 is a drawing that shows a movement regulating structure of the shelf plate 161 in accordance with the second embodiment of the present invention and in which a shelf plate 161 is in a horizontal position.

Figure 18:
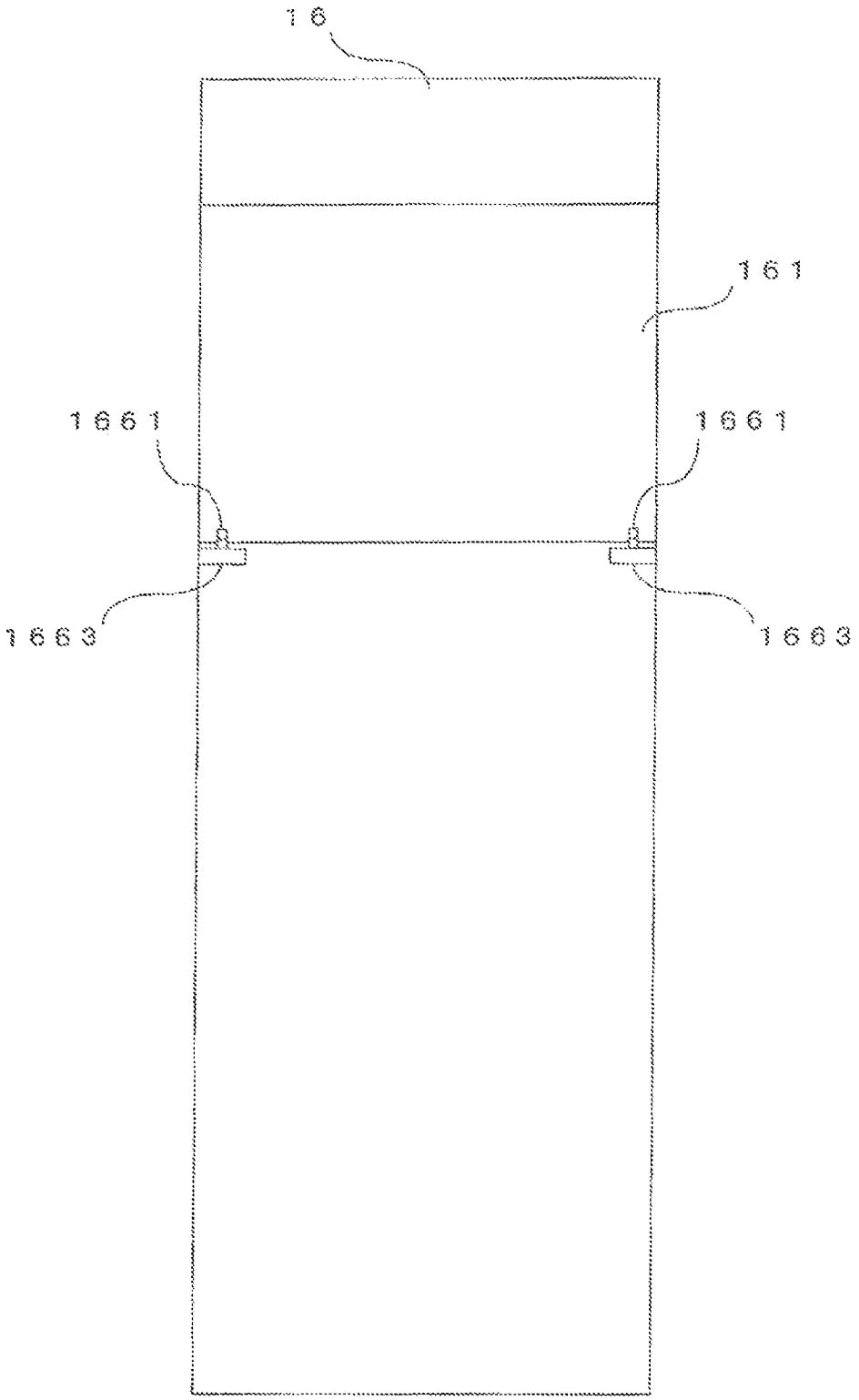
FIG. 18 is a right side face view of a housing part in accordance with the second embodiment of the present invention.

FIG. 18 is a right side face view showing a housing part 16 in accordance with the second embodiment of the present invention, which corresponds to a view seen from a door 164 direction and in which a shelf plate 161 is in a vertical position.

Figure 19:
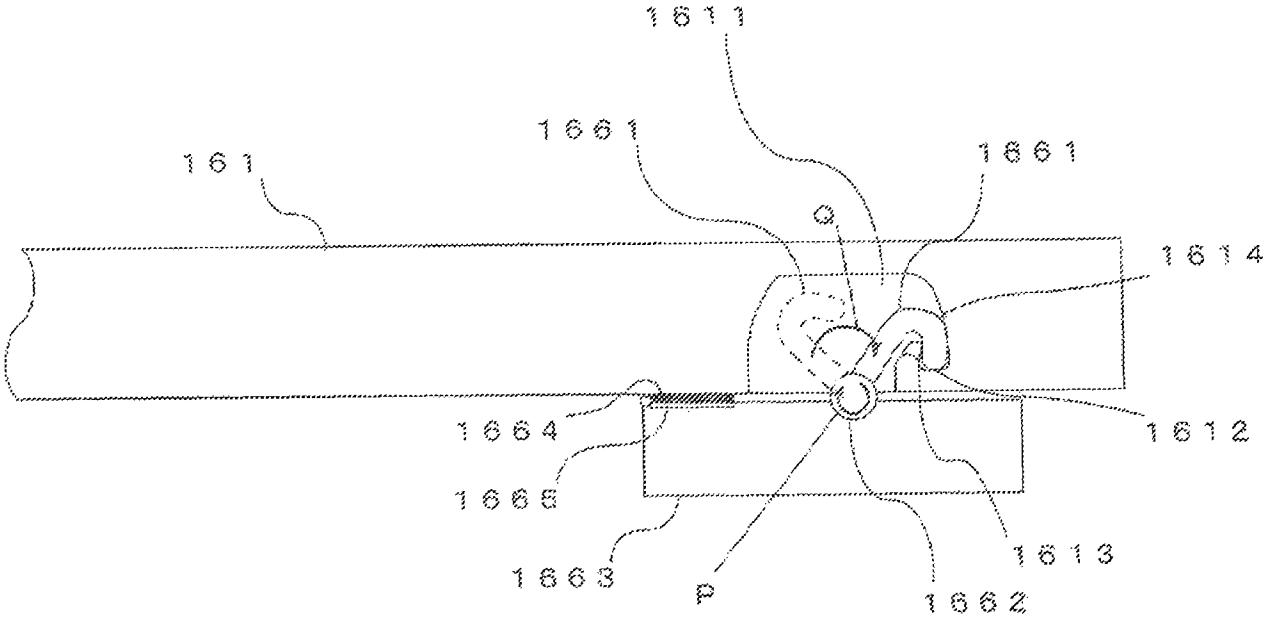
FIG. 19 is a cross-sectional view taken along line A-A in accordance with the second embodiment of the present invention.

FIG. 19 is a cross-sectional view taken along line A-A shown in FIG. 17 in which the shelf plate 161 is in the horizontal position.

Figure 20:
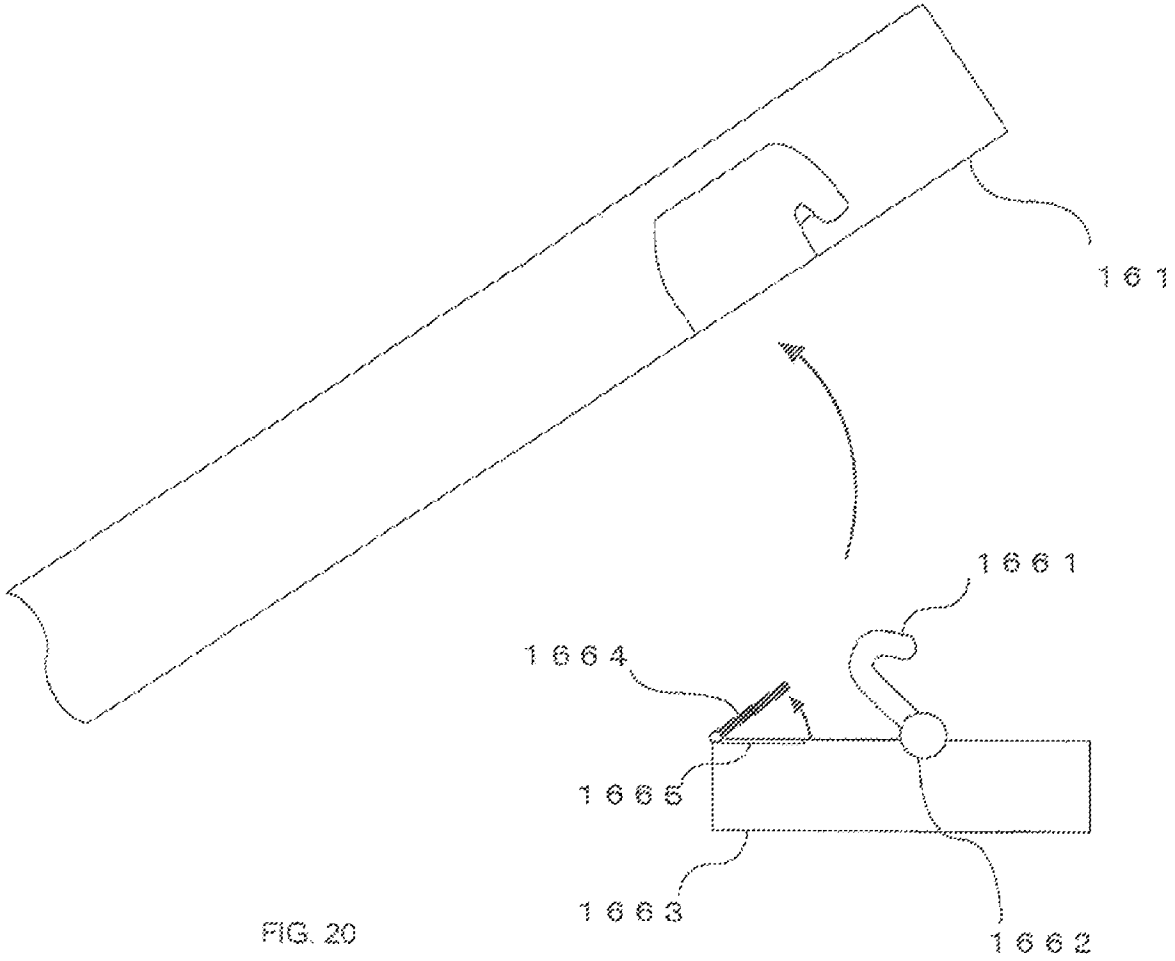
FIG. 20 is a cross-sectional view taken along line A-A in accordance with the second embodiment of the present invention.

FIG. 20 is a cross-sectional view taken along line A-A shown in FIG. 17 in which the shelf plate 161 is not in the horizontal position.

In both of FIG. 19 and FIG. 20, the right side when seen in a front view corresponds to the door 164 side.

Additionally, in FIGS. 17 to 20, one portion of the configuration is omitted for convenience of explanation.

As shown in FIGS. 17 to 20, the housing part 16 is provided with a movement regulating part 1661 that is pivoted in a predetermined direction to be engaged with the shelf plate 161 so as to regulate the movement of the shelf plate 161, a pivotal axis 1662 that is connected to the movement regulating part 1661 and a locking/unlocking part 1663 so as to transmit the rotation movement by a driving source of the corresponding locking/unlocking part 1663 to the movement regulating part 1661, the locking/unlocking part 1663 having a driving source, such as an electric motor or the like, which moves the movement regulating part 1661, a shelf plate contact part 1664 that is made in contact with the shelf plate 161 when it is moved to the horizontal position so as to move together therewith, and a shelf plate detection part 1665 that is made in contact with the above-mentioned moved shelf plate contact part 1664 so as to detect the fact that the shelf plate 161 is in the horizontal position.

As shown in FIGS. 17 to 20, the shelf plate 161 is provided with a groove part 1611 to which the above-mentioned movement regulating part 1661 is freely fitted, and which is formed on the bottom face side.

Inside of the groove part 1661, an engaging part 1612 with which the tip of the movement regulating part 1661 freely fitted thereto is formed, and to the engaging part 1612, a locking part 1613 with which the tip of the movement regulating part 1661 engaged with the engaging part 1612 is locked is formed.

The movement regulating part 1661 has a member having a hook shape, and is attached to the pivotal axis 1662 so as to pivot around the pivotal axis 1662.

In the example of the drawing, the movement regulating part 1661, the pivotal axis 1662 and the locking/unlocking part 1663 are installed one by one in the vicinity of the tip of the shelf plate 161 on the inner wall on the front face side and the back face side in the housing space of the housing part 16.

Moreover, in the example of the drawing, the movement regulating part 1661, the pivotal axis 1662 and the locking/unlocking part 1663 are installed substantially at the same height when the shelf plate 161 is in the horizontal position so that the movement regulating part 1661 can proceed into the groove part 1611 from the bottom surface side of the shelf plate 161 located at the horizontal position.

As shown in FIG. 19, when the movement regulating part 1661 is located at a cancel position indicated by a dotted line, it does not regulate the movement of the shelf plate 161 from the horizontal position to the vertical position.

Moreover, when the movement regulating part 1661 is located at a locking position indicated by a solid line, it regulates the movement of the shaft plate 161 from the horizontal position to the vertical position.

The movement regulating part 1661 pivots between the cancel position and the locking position by the driving source of the locking/unlocking part 1663.

Moreover, the movement regulating part 1661 has its pivotal angle regulated so as to pivot only between the cancel position and the locking position.

The pivotal axis 1662 has its one end of the axis connected to a driving source of the above-mentioned electric motor or the like installed on the locking/unlocking part 1663, and has its other end connected to the movement regulating part 1661.

In the case when, with a delivery object being stored at least in housing space A or B, the detection part 1605 or 1606 detects the stored state, it outputs a detection signal indicating the detected state to the control part 11.

Moreover, upon detection that the shelf plate 161 is in the horizontal position, the shelf plate detection part 1665 outputs a detection signal to the control part 11.

Upon receipt of inputs of the above-mentioned respective detection signals from the detection parts 1605 and 1606 and the shelf plate detection part 1665, the control part 11 outputs a control signal to the above-mentioned locking/unlocking part 1663, and upon receipt of the control signal, the locking/unlocking part 1663 pivots the movement regulating part 1661 around the pivotal axis 1662.

As shown in FIG. 19, the movement regulating part 1661 located at the cancel position is pivoted in an arrow P direction around the rotation axis 1662 by the locking/unlocking part 1663, as described above, and is allowed to proceed into the groove part 1611 formed on the bottom surface side of the shelf plate 161, as indicated by an arrow Q, and when the hook shaped tip part of the movement regulating part 1661 is moved to a locking position indicated by a solid line, the hook shaped tip part is engaged with the locking part 1612 having, for example, a concave shape inside the groove part 1611.

As shown in FIG. 19, the locking part 1613 is a member for locking the tip of the movement regulating part 1661, and is placed at a position opposed to the locking part 1614 on the door 164 side of the engaging part 1612 inside the groove part 1611.

The locking part 1613 exerts an urging force in the direction of the locking portion 1614 of the above-mentioned opposed engaging part 1612.

The hook shaped tip part of the movement regulating part 1661 is made in contact with the locking part 1613 and the engaging portion 1614 against the urging force of the locking part 1613, and when it is inserted between the locking part 1613 and the engaging portion 1614, while expanding its interval, by the above-mentioned urging force, the hook shaped tip part of the movement regulating part 1661 is sandwiched by the locking part 1613 and the locking portion 1614, and locked by the shelf plate 161.

Moreover, when the movement regulating part 1661 is moved to the locking position, the locking/unlocking part 1663 locks the movement of the movement regulating part 1661 around the pivotal axis 1662.

In this manner, when the movement regulating part 1661 is locked by the shelf plate 161, the movement regulating part 1661 that is engaged with the engaging part 1612 regulates the pivotal movement of the shelf plate 161 around the hinge part 1601.

Therefore, even when an external force for moving the shelf plate 161 is applied, the shelf plate 161 is maintained in the horizontal position so as to continuously maintain the state in which the housing spaces A and B are formed.

On the other hand, at the time of outputting an unlocking signal for the door 164 to the locking/unlocking part 165, the control part 11 outputs a control signal to the above-mentioned locking/unlocking part 1663, and upon receipt of the control signal, the locking/unlocking part 1663 allows the movement regulating part 1661 to pivot in a direction opposite to P around the pivotal axis 1662.

As shown in FIG. 19, the movement regulating part 1661, which is located at the locking position indicated by the solid line, with its tip being locked by the engaging part 1612 and the locking part 1613, is allowed to pivot in the direction opposite to the P direction around the pivotal axis 1662 inside the groove part 1611 to a cancel position indicated by a dotted line by the locking/unlocking part 1663 so that the hook shaped tip part of the movement regulating part 1661 is released between the engaging part 1612 and the locking part 1613 against the urging force of the above-mentioned locking part 1613, and allowed to pivot to the cancel position indicated by the dotted line.

Then, the shelf plate 161 is set to a state capable of pivoting around the hinge part 1601 to the vertical position, thereby making it possible to form the housing space C.

The shelf plate detection part 1665 is installed on the upper surface of the locking/unlocking part 1663.

The shelf plate contact part 1664 has its one portion supported on the upper surface of the locking/unlocking part 1663, and an urging force is exerted vertically upward with its support portion serving as a fulcrum.

For example, the shelf plate contact part 1664 is formed by bending a member having flexibility, such as a metal thin plate, into a predetermined angle.

As shown in FIG. 20, in the case when the shelf plate 161 is not in the horizontal position, the shelf plate contact part 1664 is located at a position that is not made in contact with the shelf plate detection part 1665 by the corresponding urging force.

On the other hand, at the time of moving the shelf plate 161 to the horizontal position, the bottom surface of the shelf plate 161 is made in contact with the upper surface of the shelf plate contact part 1664. When the shelf plate 161 is moved to the horizontal position while pressing the shelf plate contact part 1664 vertically downward, against the above-mentioned urging force, as it is, the bottom surface of the shelf plate contact part 1664 is made in contact with the upper surface of the shelf plate detection part 1665, as shown in FIG. 19.

Then, the shelf plate detection part 1665 detects that the shelf plate 161 is in the horizontal position.

For example, the shelf plate contact part 1664 and the shelf plate detection part 1665 may form electric contacts.

In this case, by making the shelf plate contact part 1664 in contact with the shelf plate detection part 1665, an electric current flows through a predetermined circuit so that the shelf plate detection part 1665 may output a detection signal based upon the corresponding electric current to the control part 11.

The shelf plate detection part 1665 is a pressure sensor, and when the shelf plate contact part 1664 presses the upper surface of the shelf plate detection part 1665, it detects the pressure so that by the corresponding pressure detection, a detection signal indicating that the shelf plate 161 is in the horizontal direction may be outputted to the control part 11.

Moreover, in the case when the shelf plate detection part 1665 is a pressure sensor, from the structural point of view, the shelf plate contact part 1664 may be omitted, and in this case, the bottom surface of the shelf plate 161 may be directly made in contact with the shelf plate detection part 1665 serving as the pressure sensor to press this, and the shelf plate detection part 1665 detects the corresponding pressure.

Additionally, the configurations and kinds of the pressure sensor are not particularly limited, and for example, general sensors, such as those detecting a change or the like in electrostatic capacitance or electric resistance value, may be used.

Moreover, the shelf plate detection part 1665 may have a configuration other than the above-mentioned electric contact or pressure sensor, as long as it can detect the position of the shelf plate 161.

Figure 21:
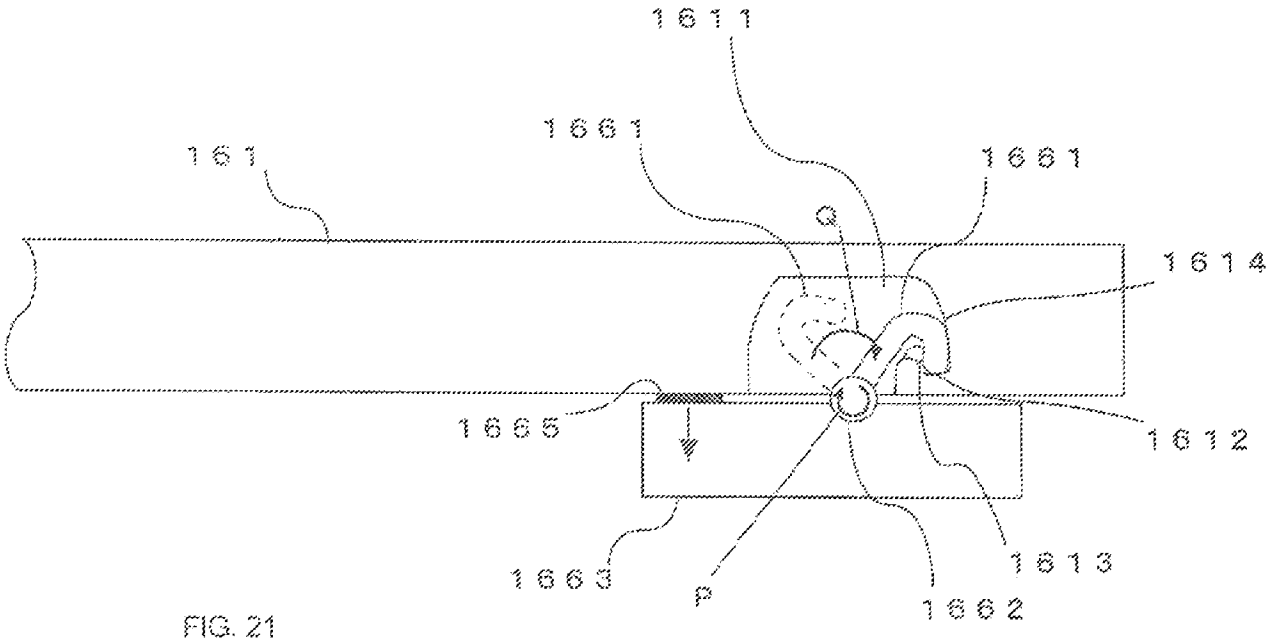
FIG. 21 is a cross-sectional view taken along line A-A in accordance with the second embodiment of the present invention.

FIG. 21 is a cross-sectional view taken along line A-A of FIG. 17, and shows a state in which the shelf plate 161 is in the horizontal position.

For example, as shown in FIG. 21, in the case when the shelf plate detection part 1665 is designed as a button that protrudes in a vertically upward direction from the upper surface of the locking/unlocking part 1663 and can be pressed in a vertically downward direction, when the shelf plate 161 is moved to the horizontal position to press the corresponding protruding button in the vertically downward direction, the shelf plate detection part 1665 may detect the movement of the shelf plate 161 in the horizontal position based upon the corresponding pressed state of the button.

Next, explanation will be given to a modified example of the second embodiment of the present invention.

The following explanation will be given on the premise that the configuration and operations in the present modified example are the same as those of the second embodiment, unless otherwise specified.

Figure 22:
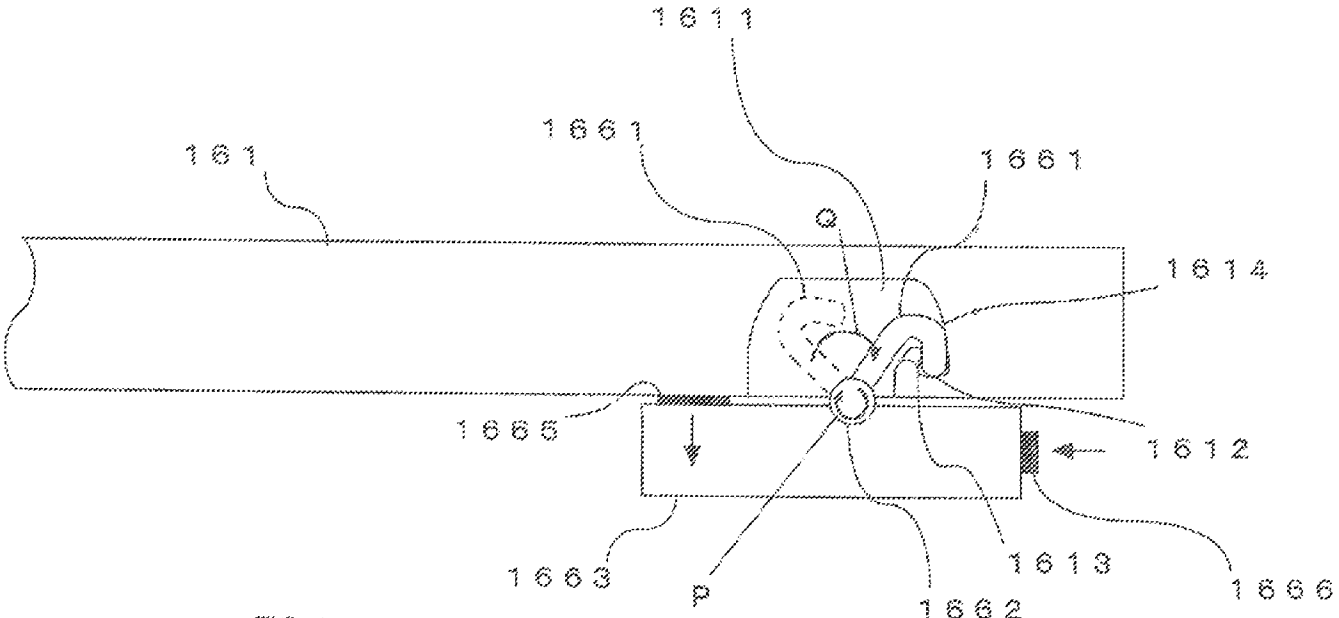
FIG. 22 is a cross-sectional view taken along line A-A in accordance with a modified example of the second embodiment of the present invention.

FIG. 22 is a cross-sectional view taken along line A-A of FIG. 17 in accordance with a modified example of the second embodiment of the present invention, and shows a state in which the shelf plate 161 is in the horizontal position.

In the present modified example, different from the second embodiment, the locking/unlocking part 1663 is constituted by not an electronic lock, but a general-use mechanical lock that carries out an unlocking/unlocking process by physical changes in members.

The shelf plate detection part 1665 is, for example, a button that protrudes in a vertically upward direction from the upper surface of the locking/unlocking part 1663 and can be pressed down in a vertically downward direction.

When the shelf plate 161 is moved to the horizontal direction and presses the corresponding protruding button in the vertically downward direction, the shelf plate detection part 1665 physically moves a predetermined member based upon the corresponding pressed down state of the button, and makes the corresponding member in contact with a predetermined portion of the locking/unlocking part 1663 so as to transmit a force exerted by the movement of the corresponding member to the locking/unlocking part 1663.

When made in contact with the member of the shelf plate detection part 1665, the locking/unlocking part 1663 allows the movement regulating part 1661 to pivot in P direction around the pivotal axis 1662.

Then, in the same manner as in the second embodiment, the hook shaped tip part of the movement regulating part 1661 that has pivoted in the P direction inside the groove part 1611 is locked by the engaging part 1612 and the locking part 1613.

Moreover, when the locking/unlocking part 1663 moves the movement regulating part 1661 until it has been engaged with the engaging part 1612, the movement around the pivotal axis 1662 is locked so that the movement of the movement regulating part 1661 is regulated.

As shown in the drawing, in the present modified example, an unlocking button 1666 for unlocking the locked shelf plate 161 by the above-mentioned movement regulating part 1661 when pressed down, is installed on the door 164 side of the locking/unlocking part 1663.

When, after opening the door 164, a user presses down the unlocking button 1666, by a dislocation due to the pressing down of the unlocking button 1666, the unlocking button 1666 is made in contact with a predetermined member inside the locking/unlocking part 1663.

Then, in the same manner as in the second embodiment, the locking/unlocking part 1663 allows the movement regulating part 1661 to pivot in a direction opposite to the P direction so that the hook shaped tip part of the movement regulating part 1661 is released between the engaging part 1612 and the locking part 1613 against the urging force of the above-mentioned locking part 1613.

Thus, the shelf plate 161 is set to a state capable of pivoting upward around the hinge part 1601 so as to form the housing space C.

As explained above, in accordance with the modified example of the second embodiment of the present invention, the locking/unlocking part 1663 is prepared as the mechanical lock, and when the shelf plate 161 is moved to the horizontal position, the movement regulating part 1661 is allowed to pivot so as to lock the movement of the shelf plate 161.

Moreover, when the unlocking button 1666 is pressed down by a user, the locking/unlocking part 1663 allows the movement regulating part 1661 to pivot so that the locked shelf plate 161 is unlocked.

In this manner, even when the locking/unlocking part 1663, the movement regulating part 1661, the pivotal axis 1662, the engaging part 1612 and the locking part 1613, etc. are not used for forming an electronic lock, but used for forming a general-use mechanical lock, it becomes possible to regulate the movement of the shelf plate 161.

Additionally, in the present modified example, the hook shaped movement regulating part 1661 is engaged with the shelf plate 161 to regulate its movement; however, not limited by this arrangement, any other general-use configurations of the mechanical lock may be used.

Moreover, in the present modified example, the unlocking button 1666 is formed on the door 164 side of the locking/unlocking part 1663.

Therefore, the user is allowed to press down the unlocking button 1666 only when the door 164 is unlocked and opened; therefore, it becomes possible to prevent the user from opening the door 162 or 163 and erroneously moving the shelf plate 161 to the vertical position in the case when a delivery object is housed either in the housing space A or B.

Additionally, the installation position of the unlocking button 1666 is not limited to the door 164 side of the above-mentioned locking/unlocking part 1663 as long as it corresponds to a position that is hardly operated from the doors 162 and 163, and may be set onto, for example, the front surface side or back surface side.

As explained above, in accordance with the second embodiment of the present invention, since the movement of the shelf plate 161 itself can be regulated by engaging the pivotal movement regulating part 1661 with one portion of the shelf plate 161, it is possible to prevent the user from erroneously moving the shelf plate 161 in the vertical position when the housing space A or B is used.

Moreover, since the movement regulating part can be installed at a position other than the back surface of the door 164, the degree of its designing freedom can be improved.

In accordance with the above-mentioned second embodiment, the movement regulating part 1661 and the locking/unlocking part 1663 are installed one by one on the inner walls on the front surface side and the back surface side in the housing space of the housing part 16; however, the installation number and installation positions thereof are not limited by these, as long as the shelf plate 161 can be regulated.

Moreover, the hook shaped tip part of the movement regulating part 1661 is engaged with the engaging part 1612 formed on the bottom surface side of the shelf plate 161; however, the position with which the corresponding hook shaped tip part is engaged is not limited by this, and for example, the upper surface side or the side surface side of the shelf plate 161 may be used.

Furthermore, in one example of the present embodiment, the shape of the movement regulating part 1661 is formed into a hook shape; however, not limited by this, any shape may be used as long as it is capable of engaging with the shelf plate 161.

In the housing device 10 in the above-mentioned second embodiment, the movement regulating part is formed into a hook shape, and the hook tip end part is engaged with the engaging part inside the groove part formed on the bottom surface side of the shelf plate 161 so that the movement of the shelf plate 161 can be regulated.

In contrast, in the housing device 10 in the third embodiment of the present invention, the movement regulating part is formed into an annular shape or the like with a through hole, and installed on the bottom surface side of the shelf plate 161 so as to protrude therefrom. When the shelf plate 161 is moved to the horizontal position, the protruded movement regulating part is engaged and locked by the engaging part of the locking/unlocking part so that the movement of the shelf plate 161 itself is regulated.

The following explanation will be given on the premise that the configuration and operations in the third embodiment of the present invention are the same as those of the second embodiment or the modified example thereof, unless otherwise specified.

Figure 23:
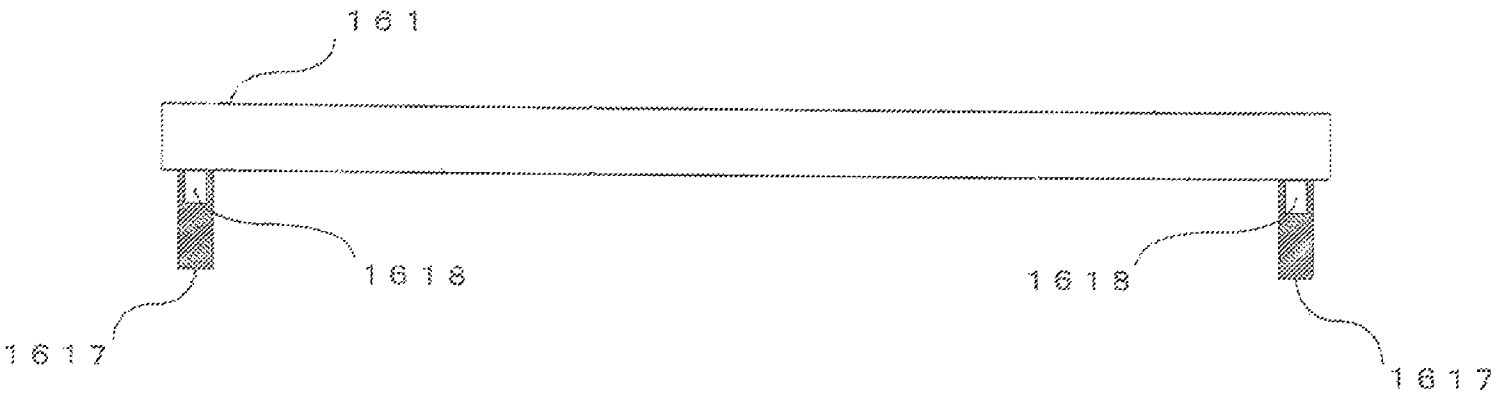
FIG. 23 is a drawing that shows an appearance of a shelf plate in accordance with a third embodiment of the present invention and corresponds to a view seen from the right side face side.

FIG. 23 is a drawing that shows an appearance of the shelf plate 161 in the third embodiment of the present invention, which is seen from the right side face side of the housing device 10.

As shown in FIG. 23, a movement regulating part 1617 is formed by a material such as metal or the like into a ⊐ -letter shape, with its opening side being fixed onto the bottom surface side of the shelf plate 161.

In the present embodiment, as shown in the drawing, for example, the movement regulating parts 1617 are installed on right and left two sides of the shelf plate 161 in directions protruding vertically downward, when seen from the front side of the drawing, when the shelf plate 161 is in the horizontal position.

A through hole 1618 is formed on the ⊐ -letter shaped movement regulating part 1617.

As will be explained later, by inserting locking parts 1671 and 1672 of the locking/unlocking part 1633 in the through holes 1618 to be locked therein, the movement of the shelf plate 161 in the vertical direction can be regulated.

Additionally, in the present example, the movement regulating part 1617 is formed into the ⊐ -letter shape; however, another shape may be used as long as the above-mentioned through hole 1618 may be formed thereon and a locked state can be set by the locking parts 1671 and 1672 in cooperation with the bottom surface of the movement regulating part 1617, and for example, an annular shape, an arc shape, or another shape, with one portion being hollowed out, may be used.

In the same manner as in the second embodiment, the appearance in the present embodiment is approximately shown by that in FIG. 17, portions different from those of FIG. 17 will be described later.

Figure 24:
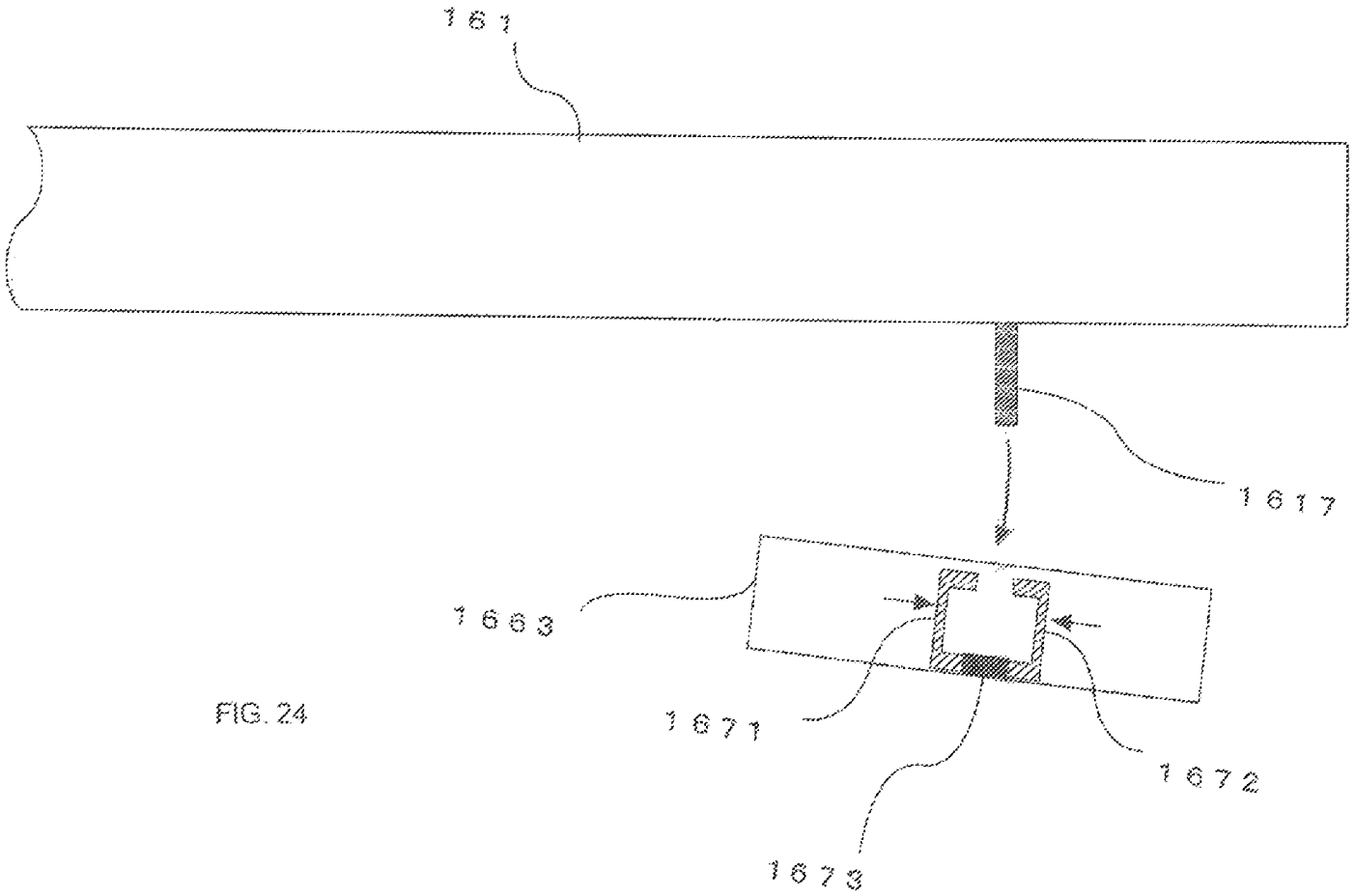
FIG. 24 is a cross-sectional view taken along line A-A in accordance with a third embodiment of the present invention.

FIG. 24 is a cross-sectional view taken along line A-A shown in FIG. 17 in the third embodiment of the present invention, which shows a state in which the shelf plate 161 is not in the horizontal position.

Figure 25:
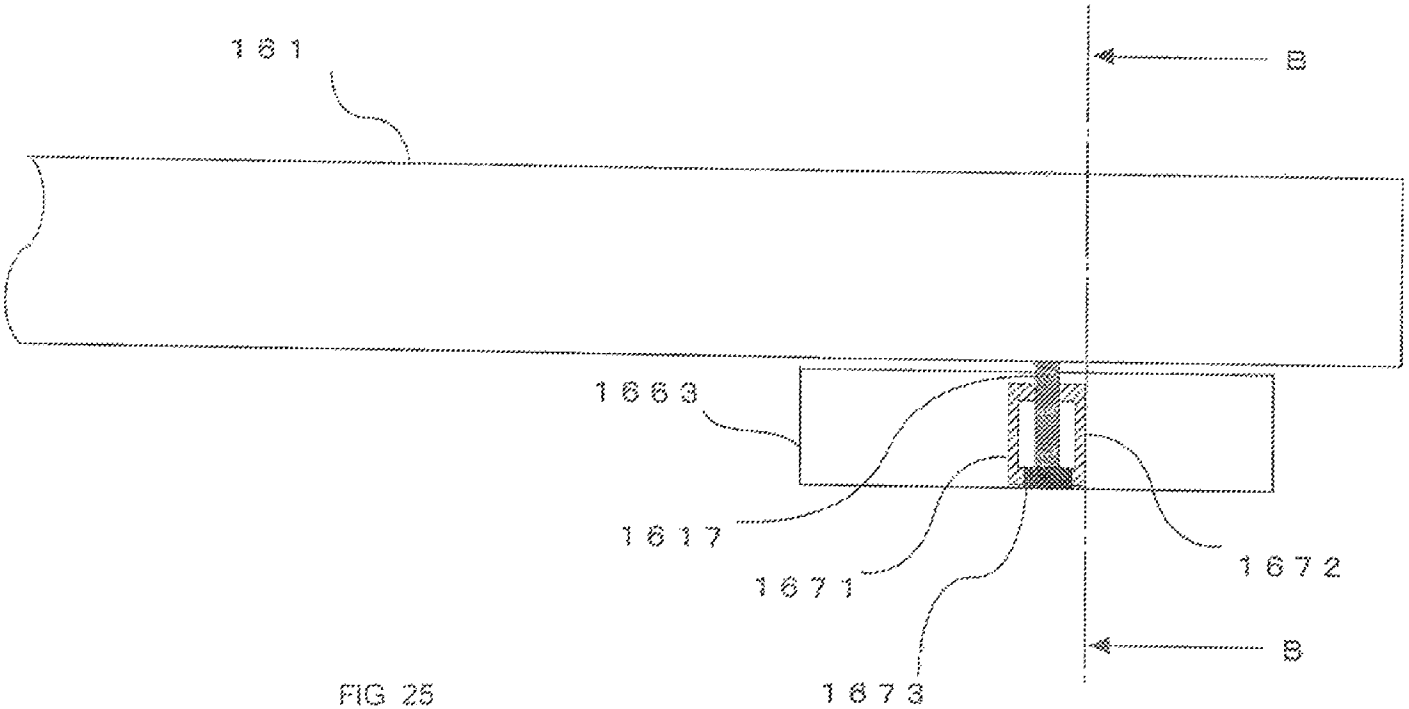
FIG. 25 is a cross-sectional view taken along line A-A in accordance with the third embodiment of the present invention.

FIG. 25 is a cross-sectional view taken along line A-A shown in FIG. 17 in the third embodiment of the present invention, which shows a state in which the shelf plate 161 is in the horizontal position.

Figure 26:
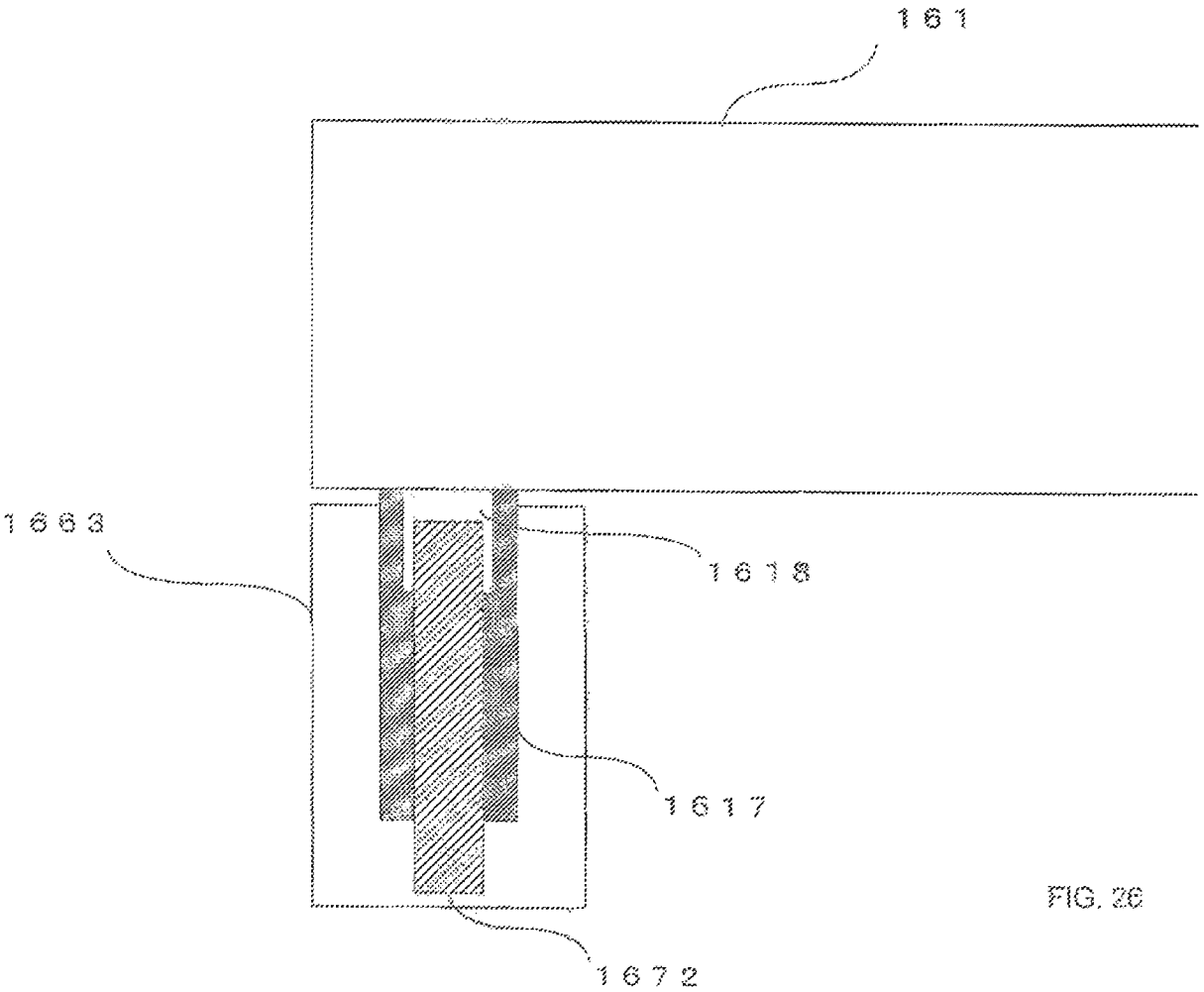
FIG. 26 is a cross-sectional view taken along line B-B in accordance with the third embodiment of the present invention.

FIG. 26 is a cross-sectional view taken along line B-B shown in FIG. 25 in the third embodiment of the present invention.

As shown in FIGS. 24 to 26, in the present embodiment, the locking/unlocking part 1663 is provided with a pair of locking parts 1671 and 1672 opposed to each other for locking the above-mentioned moving regulating part 1617 and a shelf plate detection part 1673 for detecting that the shelf plate 161 is in the horizontal position.

The locking parts 1671 and 1672 are electrically connected to the control part 11, and operated by a driving source such as an electric motor or the like by a control signal outputted from the control part 11.

For example, the tips of the locking parts 1671 and 1672 are formed into claw shapes that are mutually bent in opposed directions, as shown in the drawing, and in the case when the shelf plate 161 is not in the horizontal position, a space is formed between the corresponding two tips of the locking parts 1671 and 1672, as shown in FIG. 24.

When a control signal is inputted from the above-mentioned control part 11 to the locking/unlocking part 1663, the engaging parts 1671 and 1672 are displaced in mutually opposed directions (inner sides) so that, as shown in FIG. 25, the two tips are made in contact with each other to be set to a locked state.

Moreover, when the control part 11 outputs an unlocking signal for the door 164 to the locking/unlocking part 165, it also outputs an unlocking signal to the locking/unlocking part 1663. When the corresponding unlocking signal is inputted to the locking/unlocking part 1663, the locking parts 1671 and 1672 are displaced in mutually reversed directions (outer sides) from the opposed directions so that, as shown in FIG. 24, the two tips are separated from each other to be set to an unlocked state.

When made in contact with the tip of the above-mentioned movement regulating part 1617, the shelf plate detection part 1673 detects that the shelf plate 161 is in the horizontal direction.

For example, the shelf plate detection part 1673 is a pressure sensor, and when the tip of the movement regulating part 1617 presses the upper surface of the shelf plate detection part 1673, it detects its pressure and based upon the corresponding pressure detection, outputs a detection signal indicating that the shelf plate 161 is in the horizontal position to the control part 11.

Additionally, the configuration and kind of the pressure sensor to be used in the shelf plate detection part 1673 are not particularly limited, and for example, general sensors, such as those detecting a change or the like in electrostatic capacitance or electric resistance value, may be used.

Moreover, the shelf plate detection part 1673 may be designed to have a button shaped member having an upward urging force, and when the corresponding button shaped member is pressed vertically downward against the urging force by the above-mentioned movement regulating part 1617, the corresponding pressing force may be detected.

The shelf plate detection part 1673 outputs a detection signal indicating that the shelf plate 161 is moved to the horizontal direction to the control part 11.

Upon receipt of the input of the detection signal from the shelf plate detection part 1673, the control part 11 outputs the above-mentioned control signal to the locking parts 1671 and 1672. Upon receipt of the input of the corresponding control signal, the locking parts 1671 and 1672 are displaced in the mutually opposed directions, as described earlier, so that the two tips are made in contact with each other.

Locking Operation.

First, explanation will be given to locking operations of the shelf plate 161 by the locking/unlocking part 1663 in accordance with the third embodiment of the present invention.

After unlocking and opening the door 164, a user moves the shelf plate 161 from the vertical position to the horizontal position as described above, after he or she has taken a delivery object out of the housing space C.

When the shelf plate 161 is moved to the horizontal position, the movement regulating part 1617 installed on the bottom surface side of the shelf plate 161 is inserted between the locking parts 1671 and 1672 that are separated from each other in the unlocked state, and its tip is allowed to press the shelf plate detection part 1673.

Upon detection of the pressed pressure by the corresponding movement regulating part 1617, the shelf plate detection part 1673 outputs a detection signal of the pressed pressure to the control part 11.

Upon receipt of the input of the detection signal of the pressed pressure, the control part 11 outputs a control signal indicating a locking process by the locking parts 1671 and 1672 to the locking/unlocking part 1663.

When the above-mentioned control signal is inputted to the locking/unlocking part 1663, the locking parts 1671 and 1672 are displaced in mutually opposed directions so that the two tips of the locking parts 1671 and 1672 inserted to the through hole 1618 of the movement regulating part 1617 so that the two tips are made in contact with each other to be stopped.

In this manner, the two tips of the locking parts 1671 and 1672 are inserted to the through hole 1618 of the movement regulating part 1617 to be made in contact with each other and fixed, and by carrying out a locking process, the movement regulating part 1617 is locked by the locking parts 1671 and 1672 so that the movement of the shelf plate 161 is regulated.

In this manner, in accordance with the third embodiment of the present invention, when the shelf plate 161 is moved to the horizontal position and the movement regulating part 1617 presses the shelf plate detection part 1673, a locking process is carried out by allowing the locking parts 1671 and 1672 to lock the movement regulating part 1617 so that the shelf plate 161 is fixed in the horizontal position.

Unlocking Operations.

Next, explanation will be given to unlocking operations of the shelf plate 161 by the locking/unlocking part 1663 in accordance with the third embodiment of the present invention.

When upon determination that the identification is successful, the control part 11 outputs a control signal for unlocking the door 164 to the locking/unlocking part 165, the control signal for unlocking the locked state by the locking parts 1671 and 1672 is outputted to the locking/unlocking part 1663.

Upon receipt of the above-mentioned unlocking signal, the locking/unlocking part 1663 makes the locking parts 1671 and 1672 displace in mutually reversed directions (outer sides) from the opposed directions so that a gap is generated between the tips of the locking parts 1671 and 1672.

In this manner, since the locking/unlocking parts 1663 releases the shelf plate 161, and carries out an unlocking process, a user is allowed to move the shelf plate 161 to the vertical direction so as to form the housing space C.

As explained above, in accordance with the third embodiment of the present invention, since by moving the tips of the locking parts 1671 and 1672 in mutually opposed directions so as to be inserted into the through hole 1618 of the movement regulating part 1617, the tips in this state are made in contact with each other and fixed, the movement of the shelf plate 161 itself can be regulated; therefore, it is possible to prevent a user from erroneously moving the shelf plate 161 to the vertical position, when the housing space A or B is used.

Since the movement regulating part can be installed at a position other than the back surface of the door 164, the degree of its designing freedom can be improved.

In accordance with the above-mentioned third embodiment, the movement regulating part 1617 is installed on the back surface of the shelf plate 161, and the locking/unlocking parts 1663 are installed one by one on the inner walls on the front surface side and the back surface side in the housing space of the housing part 16; however, the installation number and installation positions thereof are not limited by those of the above-mentioned example, as long as the shelf plate 161 can be regulated.

In the third embodiment, the shape of the movement regulating part 1617 is formed into an annular shape or a コ-letter shape; however, the present invention is not intended to be limited by the above-mentioned examples, as long as the shape is lockable by the locking parts 1671 and 1672.

In the third embodiment, the driving source of the electric motor or the like is designed to move the locking parts 1671 and 1672 in mutually opposed directions or the reversed directions therefrom; however, the driving mechanism of the locking parts 1671 and 1672 is not intended to be limited by the present example, and other general-use driving mechanisms may be used.

In the third embodiment as explained above, the locking/unlocking part 1663 is constituted by an electronic lock that carries out locking/unlocking processes based upon a control signal from the control part 11; however, as in the case of the modified example of the second embodiment, a general-use mechanical lock that carries out locking/unlocking processes by physical changes in members.

In this case, in the same manner as in the modified example of the second embodiment, an unlocking button for unlocking the locked state of the shelf plate 161 by the above-mentioned locking/unlocking part 1663 when pressed down may be installed on the door 164 side of the locking/unlocking part 1663.

The housing device 10 in the aforementioned first embodiment has a square pillar shape, and the display part 14 and the operation part 15 are installed on the front surface, and doors 162 to 164 of the housing boxes are formed on the right and left two side faces thereof.

In contrast, a housing device 10 in accordance with the fourth embodiment of the present invention has a column shape, and on the side face of the column, a display part 14, an operation part 15 and doors 162 to 164 of housing boxes are installed.

Hereinbelow, explanation will be given on the premise that the configuration and operations in the fourth embodiment of the present invention are the same as those of the first embodiment and its modified example, unless otherwise specified.

Figure 27:
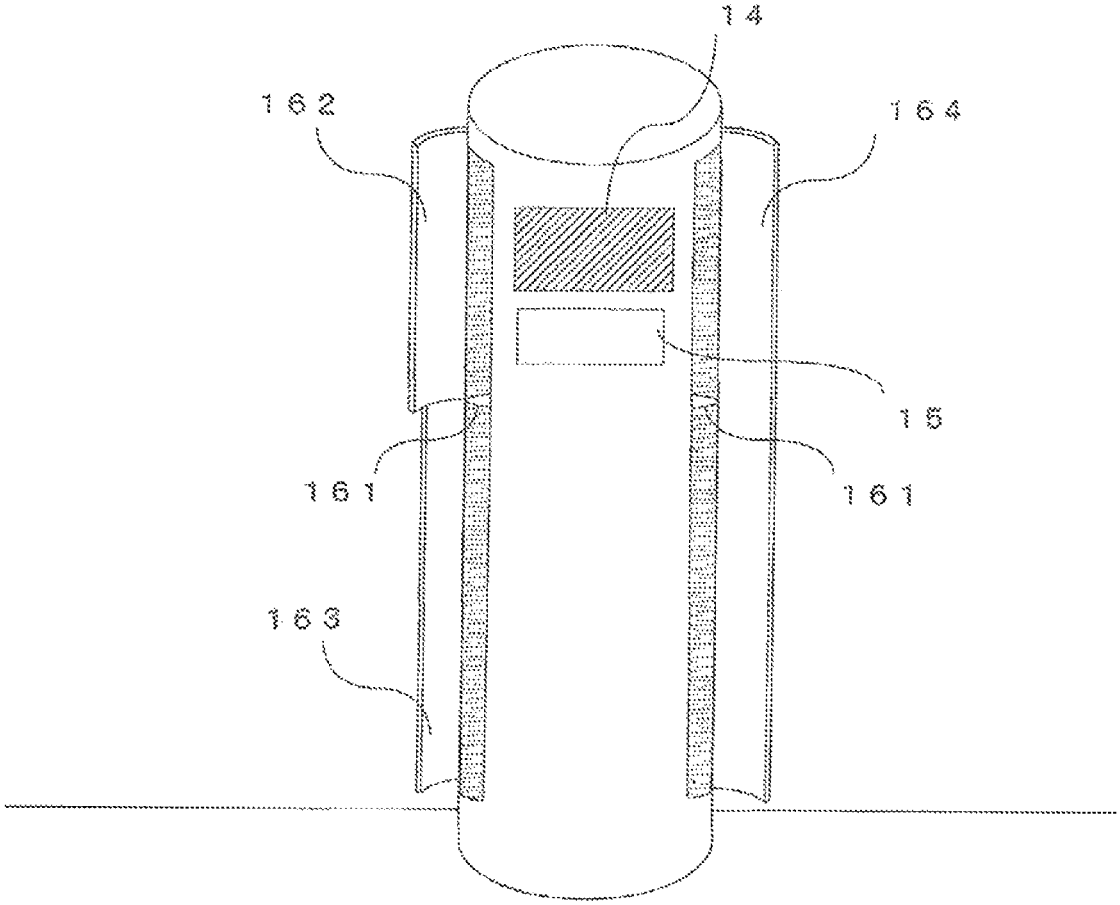
FIG. 27 is a drawing that shows an appearance of a housing device in accordance with a fourth embodiment of the present invention.

FIG. 27 is a drawing that shows an appearance of a housing device 10 in the fourth embodiment of the present invention.

As shown in the drawing, the housing device 10 has a column shape.

In the present embodiment, on the front face side on the column side face, a display part 14 and an operation part 15 are installed, and on the right and left two side face sides of the same column side face, doors 162 to 164 of housing boxes are installed.

As explained above, the housing device 10 in accordance with the fourth embodiment of the present invention has a column shape and since the display part 14, the operation part 15 and the doors 162 to 164 of the housing boxes are installed on its side face; therefore, even under such an environment in which the installation of the housing device 10 having a square pillar shape as in the case of the first embodiment is difficult due to the opening and closing directions, the installation area or the like, the column shaped housing device 10 as in the case of the present embodiment can be sometimes installed so that the installable place for the housing device 10 can be expanded.

Additionally, in the present embodiment, the housing device 10 is formed into a column shape; however, other shapes and configurations can be used as long as the surface on which the display part 14 and the operation part 15 are formed is different from a surface on which the doors 162 to 164 of housing boxes are installed.

Moreover, as described above, the housing device 10 is formed into a square pillar shape in the first and second embodiments and it is formed into a column shape in the fourth embodiment; however, it may be formed into other polygonal pillar shapes or shapes similar to a column shape.

As explained above, in accordance with the housing systems of the first to fourth embodiments of the present invention, since the housing device 10 is designed such that the display part 14 and the operation part 15 are disposed on the surface different from a surface on which the doors 162 to 164 of housing boxes are disposed, the areas of the doors of the housing boxes and the opening parts can be made larger to ensure a sufficient housing space so that a large-size or long-size article can be housed.

The above-mentioned housing device 10 and the managing server 20 are realized by programs loaded mainly in a CPU and a memory. However, this device or server may be formed by a combination of other desired hardware and software, and high degree of freedom in designing can be easily understood by a person skilled in the art.

Moreover, in the case when the above-mentioned housing device 10 or the managing server 20 are constituted by a group of software modules, this program may be recorded in a recording medium, such as an optical recording medium, an magnetic recording medium, a magneto-optical recording medium, a semiconductor or the like, or may be loaded from the above-mentioned recording medium, or may be loaded from an external apparatus connected thereto through a predetermined network.

Additionally, the above-mentioned embodiments are merely examples of desirable embodiments of the present invention, and the embodiments of the present invention are not intended to be limited thereby, and various modifications may be made therein within the scope without departing from the gist of the present invention.

In the first to fourth embodiments of the present invention, as means (information output part) for outputting information, the display part 14 is installed on the housing device 10; however, a speaker or the like for outputting voice in place of image may be installed or both of these may be installed.

In the first to fourth embodiments as explained above, the control part 11 executes an identifying process of a user in accordance with the purpose of use for the housing device 10; however, in the case when a user ID is stored in the housing box DB 122 in place of the purpose of use or in addition thereto, upon input of the corresponding user ID through the operation part 15, the identification may be determined as successful.

Moreover, in the first to fourth embodiments as explained above, the housing device 10 is connected through the managing server 20 and a network; however, the housing device may have an off-line configuration as a single device without being connected thereto.

EXPLANATION OF REFERENCE NUMERALS

10 housing device
11, 21 control part

12, 22 information storage part
13, 23 communication part
14 display part
15 operation part
16 housing part
17 post part
18 circuit housing part
20 managing server
121, 221 identification DB
122 housing box DB
161 shelf plate
162 to 164, 172 door
165, 1663 locking/unlocking part
171 post opening
1601 hinge part
1602, 1617, 1661 movement regulating part
1605 to 1607 detection part
1611 groove part
1612 engaging part
1613, 1671, 1672 locking part
1614 locking portion of engaging part
1618 through hole
1662 pivotal axis
1664 shelf plate contact part
1665, 1673 shelf plate detection part
1666 unlocking button

The invention claimed is:

1. A housing device provided with a housing box capable of housing an article, with one portion of the housing box provided with an opening part formed thereon, further comprising:

a door that shields the opening part, and is designed so as to be lockable;

an operation part for executing an operation for unlocking the door; and an information output part for outputting information at the time of unlocking the door, wherein the door of the housing box is installed on a surface different from a surface on which the operation part and the information output part are installed;

wherein a plurality of additional opening parts of the housing box are provided on respectively different surfaces thereof and one or more shelf plates are formed inside the housing box so as to partition the housing space of the housing box into plural housing spaces; and wherein one of the additional opening parts is provided with doors for the respective plural housing spaces, and another one of the additional opening parts is provided with a door in a manner so as to straddle over the plural housing spaces.

2. The housing device according to claim 1, further comprising:

a control part for controlling the entire housing device; and a detection part that detects an article housed in the housing space and outputs a detection signal indicating the detection results to the control part, wherein upon receipt of the input of the detection signal indicating which one of the plural housing spaces houses an article, the control part executes an unlocking process of the door that shields the opening part of the housing space that houses the article and the other housing space in a straddling manner.

3. The housing device according to claim 2, wherein the shelf plate is designed so as to cancel the partition by being moved, a movement regulating part for regulating the movement of the shelf plate is installed, and in the case when the door that is provided so as to straddle over the plural housing spaces is unlocked, the movement regulating part cancels the regulation of the movement of the shelf plate that partitions the plural housing spaces.

4. The housing device according to claim 2, further comprising:

wherein in the case when the article detection part detects that an article is housed in any one of the partitioned housing spaces, the housing operation part regulates the unlocking of the door that is installed in a manner so as to straddle over the plural housing spaces including the housing space in which the article is housed.

5. The housing device according to claim 1, wherein the shelf plate is designed so as to cancel the partition by being moved, a movement regulating part for regulating the movement of the shelf plate is installed, and in the case when the door that is provided so as to straddle over the plural housing spaces is unlocked, the movement regulating part cancels the regulation of the movement of the shelf plate that partitions the plural housing spaces.

6. The housing device according to claim 5, further comprising:

an article detection part for detecting that an article is housed inside of the housing box, wherein in the case when the article detection part detects that an article is housed in any one of the partitioned housing spaces, the operation part regulates the unlocking of the door that is installed in a manner so as to straddle over the plural housing spaces including the housing space in which the article is housed.

7. The housing device according to claim 1, further comprising:

an article detection part for detecting that an article is housed inside of the housing box, wherein in the case when the article detection part detects that an article is housed in any one of the partitioned housing spaces, the operation part regulates the unlocking of the door that is installed in a manner so as to straddle over the plural housing spaces including the housing space in which the article is housed.

* * * * *